US012351382B2

(12) United States Patent
Bragg et al.

(10) Patent No.: US 12,351,382 B2
(45) Date of Patent: Jul. 8, 2025

(54) BEVERAGE CONTAINER

(71) Applicant: Berry Global, Inc., Evansville, IN (US)

(72) Inventors: Braxton J. Bragg, Evansville, IN (US); Jonathan Eickhoff, Evansville, IN (US); Jeffrey A. Mann, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 17/563,254

(22) Filed: Dec. 28, 2021

(65) Prior Publication Data

US 2022/0204247 A1 Jun. 30, 2022

Related U.S. Application Data

(60) Provisional application No. 63/256,205, filed on Oct. 15, 2021, provisional application No. 63/131,062, filed on Dec. 28, 2020.

(51) Int. Cl.

| | |
|---|---|
| ***B65D 81/38*** | (2006.01) |
| ***B65D 1/26*** | (2006.01) |
| ***B65D 21/02*** | (2006.01) |

(52) U.S. Cl.

CPC ..... *B65D 81/3869* (2013.01); *B65D 1/265* (2013.01); *B65D 21/0233* (2013.01)

(58) Field of Classification Search

CPC ..... B65D 81/3869; B65D 81/3893; B65D 81/3881; B65D 81/027; B65D 81/3806; B65D 81/3818; B65D 81/383; B65D 81/3841; B65D 3/22; B65D 21/0233; B65D 5/0281; B65D 7/22; B65D 11/16; B65D 2501/24808

USPC ... 220/592.17, 592.16, 592.27, 573.5, 573.4, 220/592.2, 592.26, 23.89, 23.88, 528, 220/23.87; 206/514

See application file for complete search history.

(56) References Cited

U.S. PATENT DOCUMENTS

| | | | | |
|---|---|---|---|---|
| 3,156,279 | A * | 11/1964 | Grebowiec | A45D 40/0068 215/44 |
| 3,765,559 | A * | 10/1973 | Sauey | A47G 19/2288 220/592.24 |
| 3,871,543 | A * | 3/1975 | Chadfield | A45D 40/0068 215/12.1 |
| 4,383,611 | A * | 5/1983 | Kreeger | B65D 21/041 206/505 |
| 5,852,896 | A | 12/1998 | Flasch, Jr. | |
| 6,065,300 | A | 5/2000 | Anthony | |
| 6,663,926 | B1 * | 12/2003 | Okushita | B65D 3/22 428/34.2 |
| 7,699,216 | B2 | 4/2010 | Smith | |

(Continued)

FOREIGN PATENT DOCUMENTS

| | | | |
|---|---|---|---|
| EP | 1902654 | B1 | 3/2008 |
| WO | 2019145924 | A2 | 8/2019 |

OTHER PUBLICATIONS

International (PCT) Search Report and Written Opinion for PCT/US21/42798 dated Oct. 26, 2021, BP-574 PCT, 6 pages.

*Primary Examiner* — Robert Poon

(74) *Attorney, Agent, or Firm* — Barnes & Thornburg LLP

(57) ABSTRACT

An insulative beverage container includes an outer cup and an inner gap support. The outer cup includes a cup brim, a cup floor, and a cup body. The inner gap support is configured to fit within an interior space of the outer cup and includes a gap-support brim, a gap-support floor, and gap-support body.

11 Claims, 41 Drawing Sheets

(56) References Cited

U.S. PATENT DOCUMENTS

| | | | | |
|---|---|---|---|---|
| 8,932,428 | B2 | 1/2015 | D Amato | |
| 9,339,979 | B2 | 5/2016 | Crawley | |
| D813,606 | S | 3/2018 | O'Nan | |
| D851,998 | S | 6/2019 | O'Nan | |
| 10,477,998 | B2 | 11/2019 | O'Nan | |
| 10,478,000 | B2 | 11/2019 | Choi | |
| 11,426,025 | B1 * | 8/2022 | Amirault | A47J 36/2405 |
| 2008/0302800 | A1 | 12/2008 | Chou | |
| 2010/0108693 | A1 * | 5/2010 | Zhang | B65D 1/265<br>220/592.2 |
| 2012/0111877 | A1 * | 5/2012 | Marshall | B65D 3/22<br>220/669 |
| 2016/0280412 | A1 * | 9/2016 | D'Amato | B65D 81/3869 |
| 2018/0014674 | A1 | 1/2018 | Pan | |
| 2020/0317402 | A1 * | 10/2020 | Kisari | B65D 1/16 |

* cited by examiner

| Cup | Time @ 50F |
|---|---|
| Single Wall PP | 53 min |
| Single Wall Paper | 68 min |
| Double Cup PP | 124 min |
| Versalite® | 147 min |
| Container 10 | 155 min |

*FIG. 12*

| Cup | Condensation @ 90min |
|---|---|
| Single Wall PP | 21.9g H2O |
| Single Wall Paper | 20.9g H2O |
| Double Cup PP | 17.5g H2O |
| Versalite® | 15.5g H2O |
| Container 10 | 11.9g H2O |

*FIG. 13B*

BEVERAGE CONTAINER

PRIORITY CLAIM

This application claims priority under 35 U.S.C. § 119(e) to U.S. Provisional Application No. 63/256,205, filed Oct. 15, 2021, and to U.S. Provisional Application No. 63/131,062, filed Dec. 28, 2020, each of which is expressly incorporated by reference herein.

BACKGROUND

The present disclosure relates to a container, and particularly to a beverage container. More particularly, the present disclosure relates to a beverage container that is insulative.

SUMMARY

According to the present disclosure, a beverage container includes an outer cup and an inner gap support. The inner gap support is sized to fit within an interior space formed in the outer cup. The outer cup may be a cup with a single-walled structure that is configured to hold liquids or other suitable products. When inserted into the outer cup, the inner gap support is at least partially spaced apart from the outer cup to provide an insulative air-gap between the outer cup and the inner cup so that the beverage container may be used with hot and cold liquids.

In illustrative embodiments, the inner gap support includes a spacer section, a retainer section, and a stack section. The spacer section includes a plurality of spacer ribs that provide a series of stacked peaks and air-gap depressions to maintain the insulative air-gap between the inner gap support and the outer cup. The retainer section is configured to cooperate with a corresponding feature formed on the outer cup to retain the inner gap support to the outer cup within the interior space. The stack section is configured to facilitate separation of two or more beverage containers and separation of two or more inner gap supports that are stacked together for storage.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of a beverage container in accordance with the present disclosure, with portions broken away to show that the beverage container includes an outer cup and an inner gap support that is sized to fit within an interior space formed in the outer cup to establish an insulative air-gap radially between the outer cup and the inner gap support relative to a central axis of the beverage container, as shown in FIG. 3, so that the beverage container may be filled with hot or cold liquids while insulating the liquids from the outer cup;

FIG. 2 is an exploded assembly view of the beverage container showing, from top to bottom, the inner gap support and the outer cup, the inner gap support including a gap-support foundation, a gap-support brim, and a gap-support body extending between and interconnecting the gap-support foundation and the gap-support brim, the gap-support body including a plurality of annular spacer ribs and a plurality of gap-support retainer tabs that are configured to interlock with corresponding features on the outer cup to provide a snap-fit interface between the outer cup and the inner gap support when the inner gap support is inserted into the interior space of the outer cup as shown in FIG. 3;

FIG. 3 is a sectional and diagrammatic view taken along line 3-3 in FIG. 1 showing the insulative air-gap radially between the inner gap support and the outer cup maintained by the plurality of annular spacer ribs and showing each of the plurality of gap-support retainer tabs interlocked with a corresponding feature on the outer cup to retain the inner gap support to the outer cup within the interior space of the outer cup;

FIG. 4 is an enlarged cross sectional view of the beverage container from FIG. 3;

FIG. 5 is an enlarged portion of the sectional view from FIG. 4 showing several of the plurality of spacer ribs spaced apart from an inner surface of the outer cup so that the insulative air-gap is continuous around a circumference of the inner gap support and showing that the plurality of spacer ribs that are stacked on top of one another to provide separate pockets within the insulative air-gap that are maintained by the plurality of spacer ribs when a user grips the beverage container and the outer cup deflects toward the inner gap support;

Figure 7:
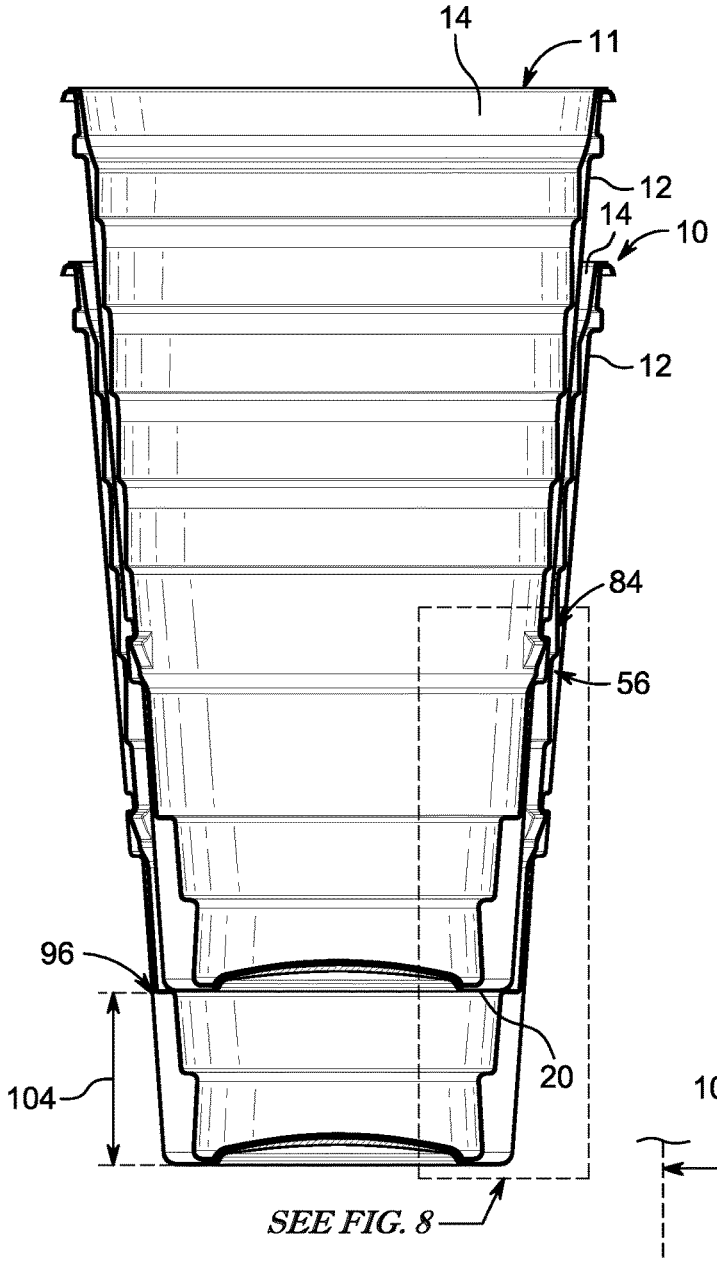
FIG. 7 is a sectional view of a top beverage container stacked within an identical bottom beverage container for storage and/or transport.
Figure 8:
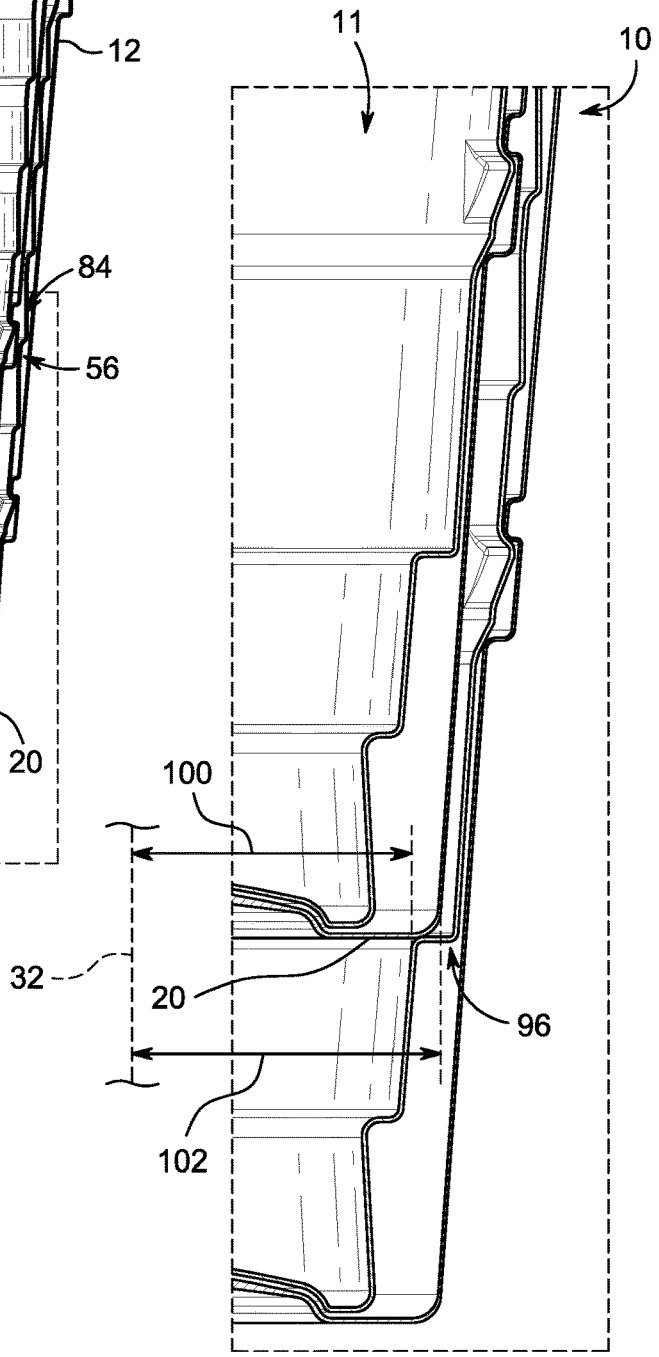
Figure 9:
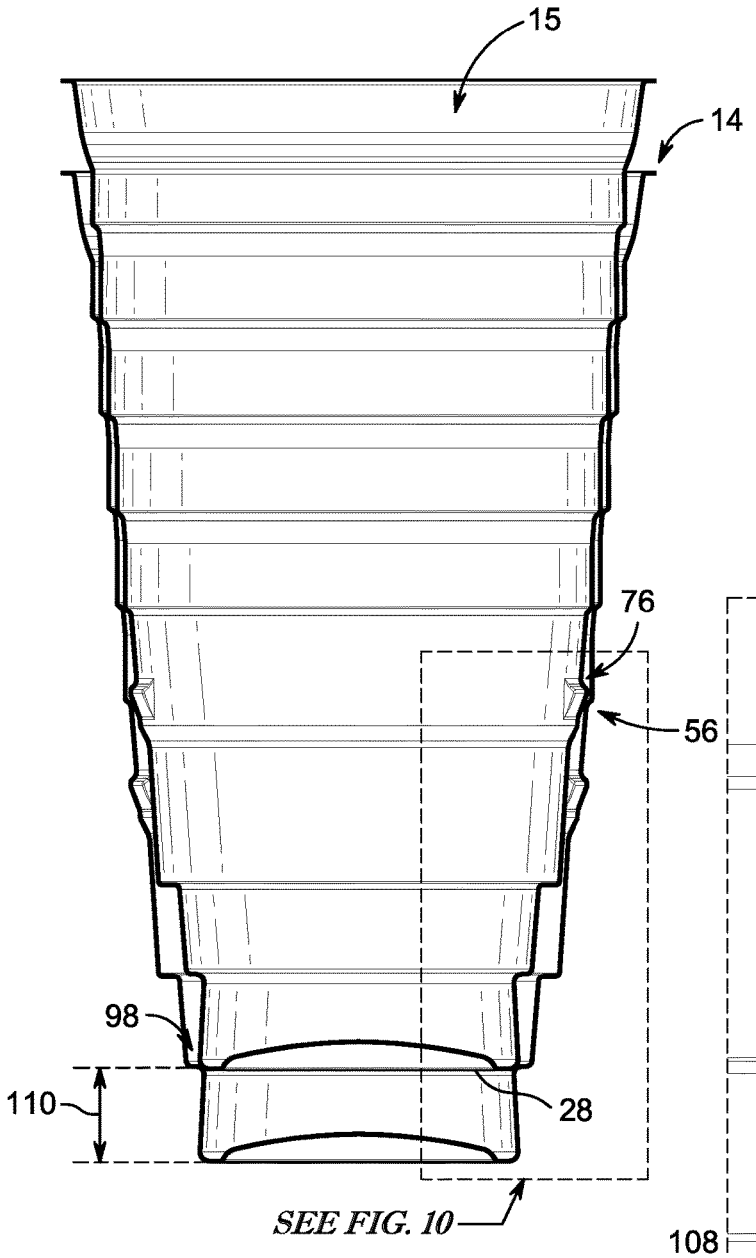
Figure 10:
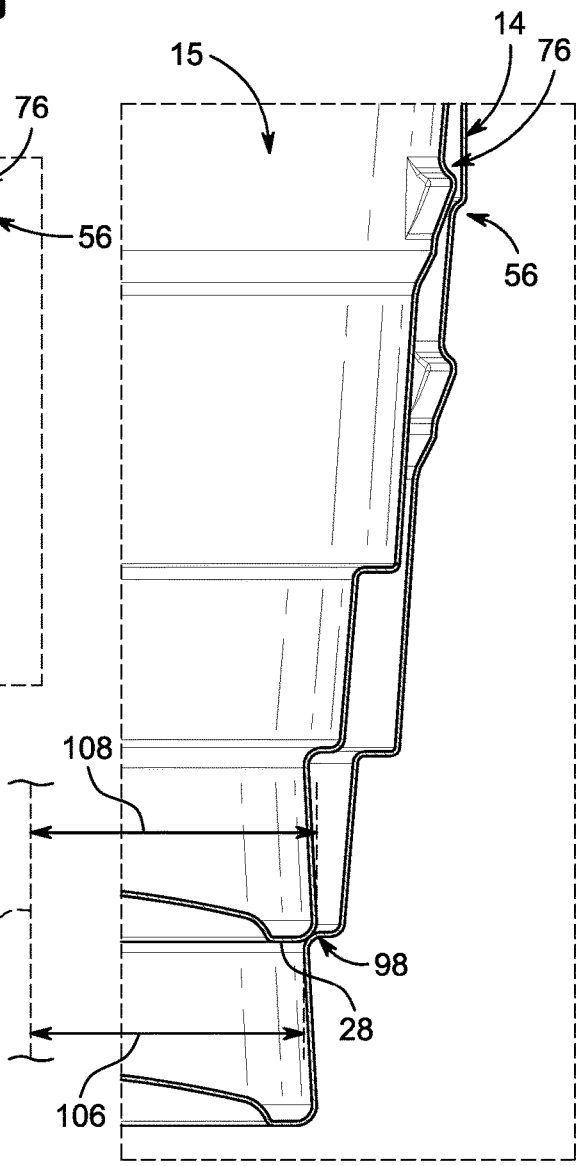
Figure 11:
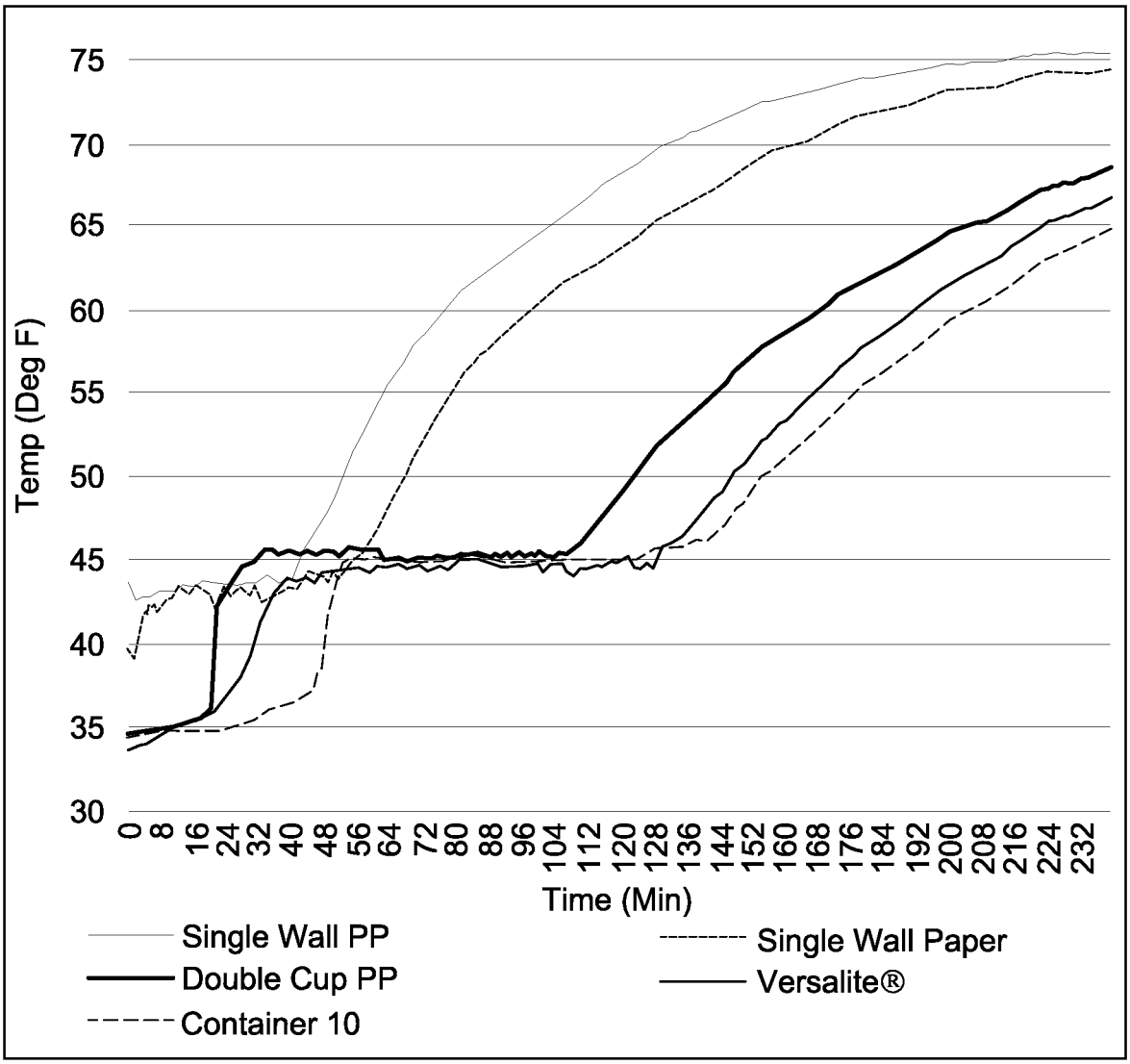
Figure 13A:
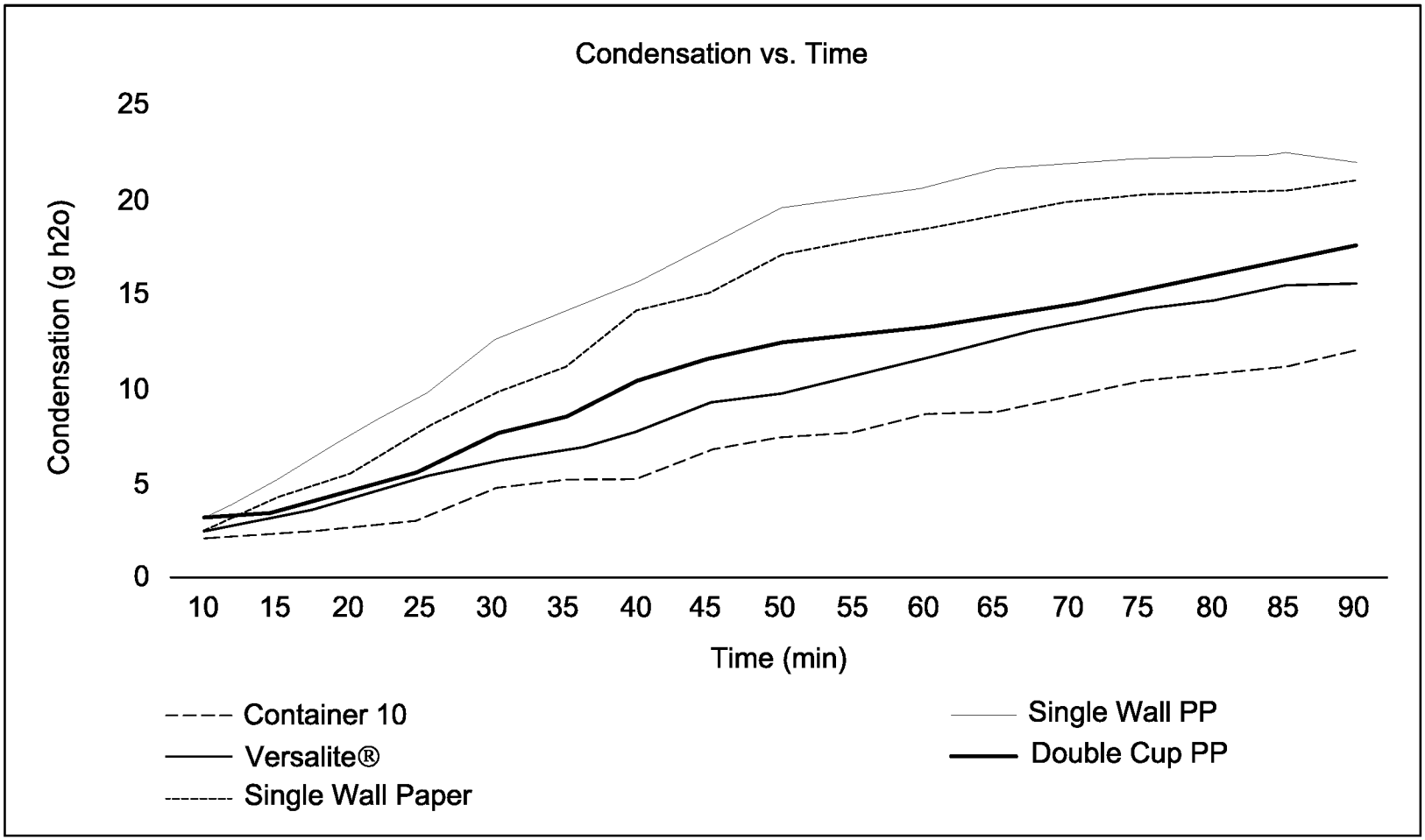
Figure 14:
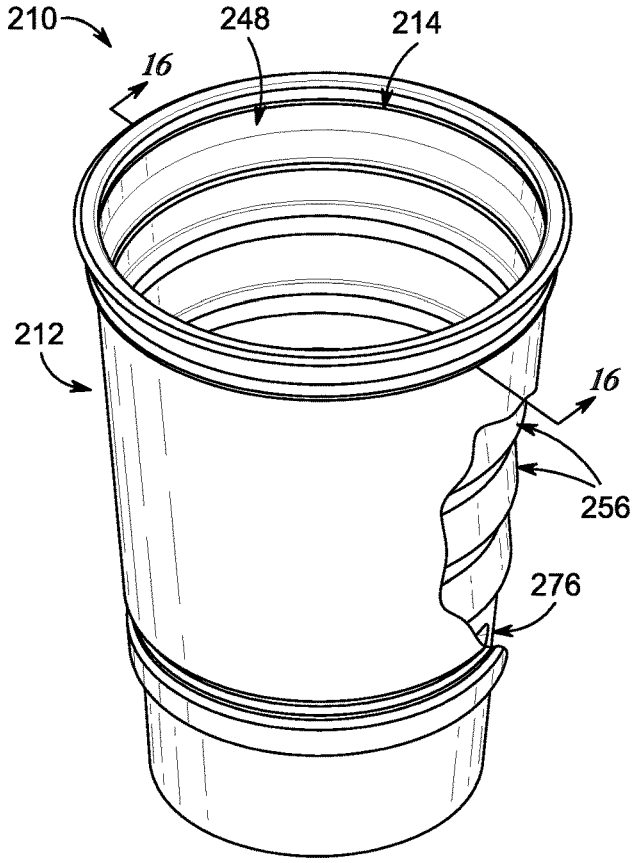
Figure 16:
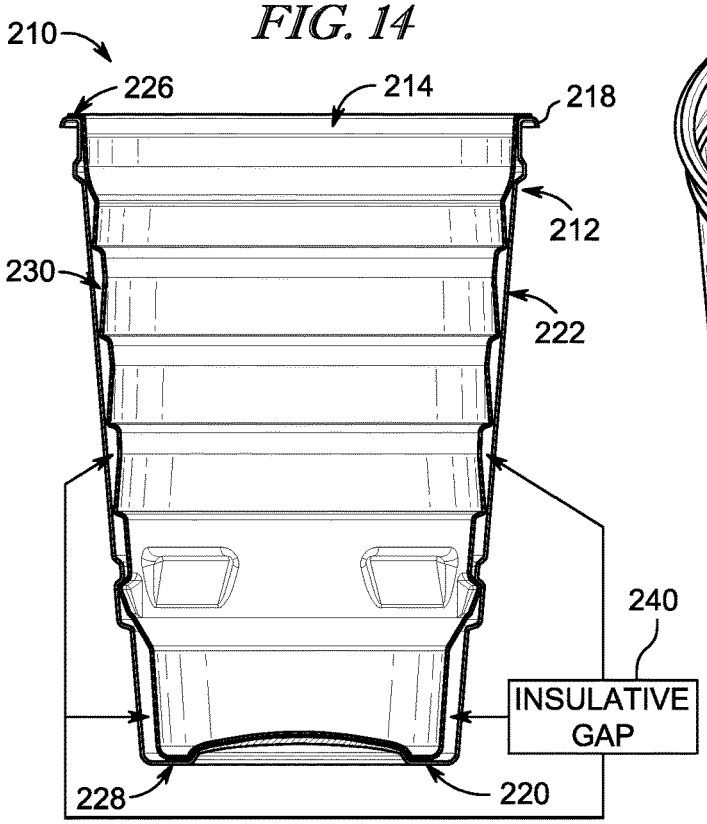
Figure 15:
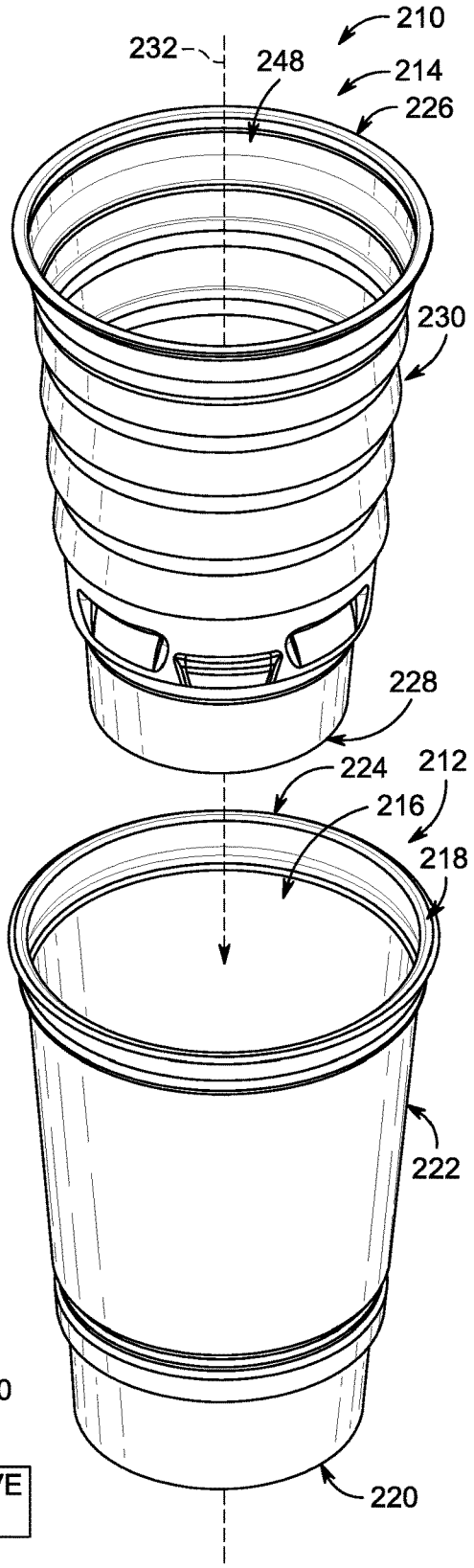
Figure 17:
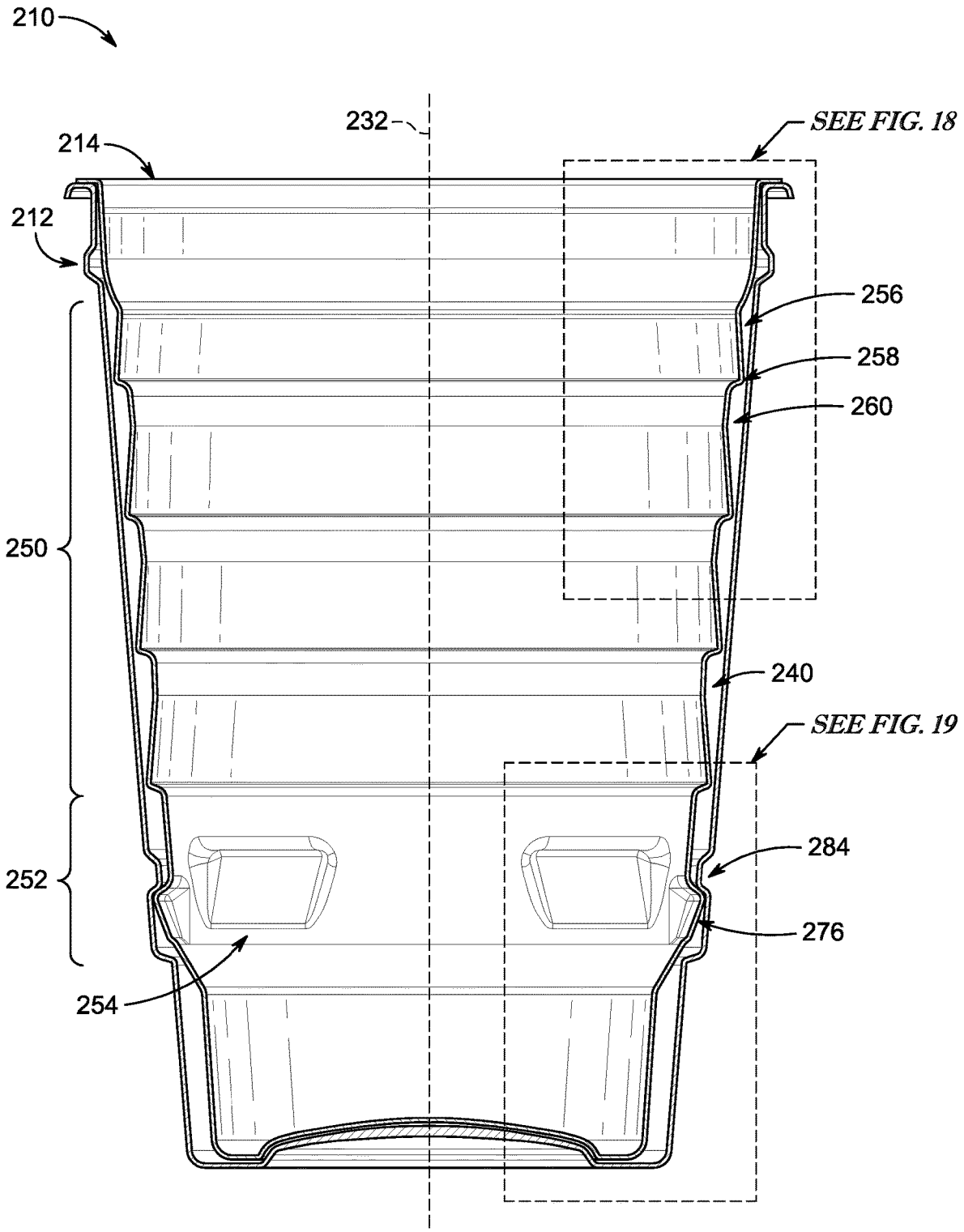
Figure 18:
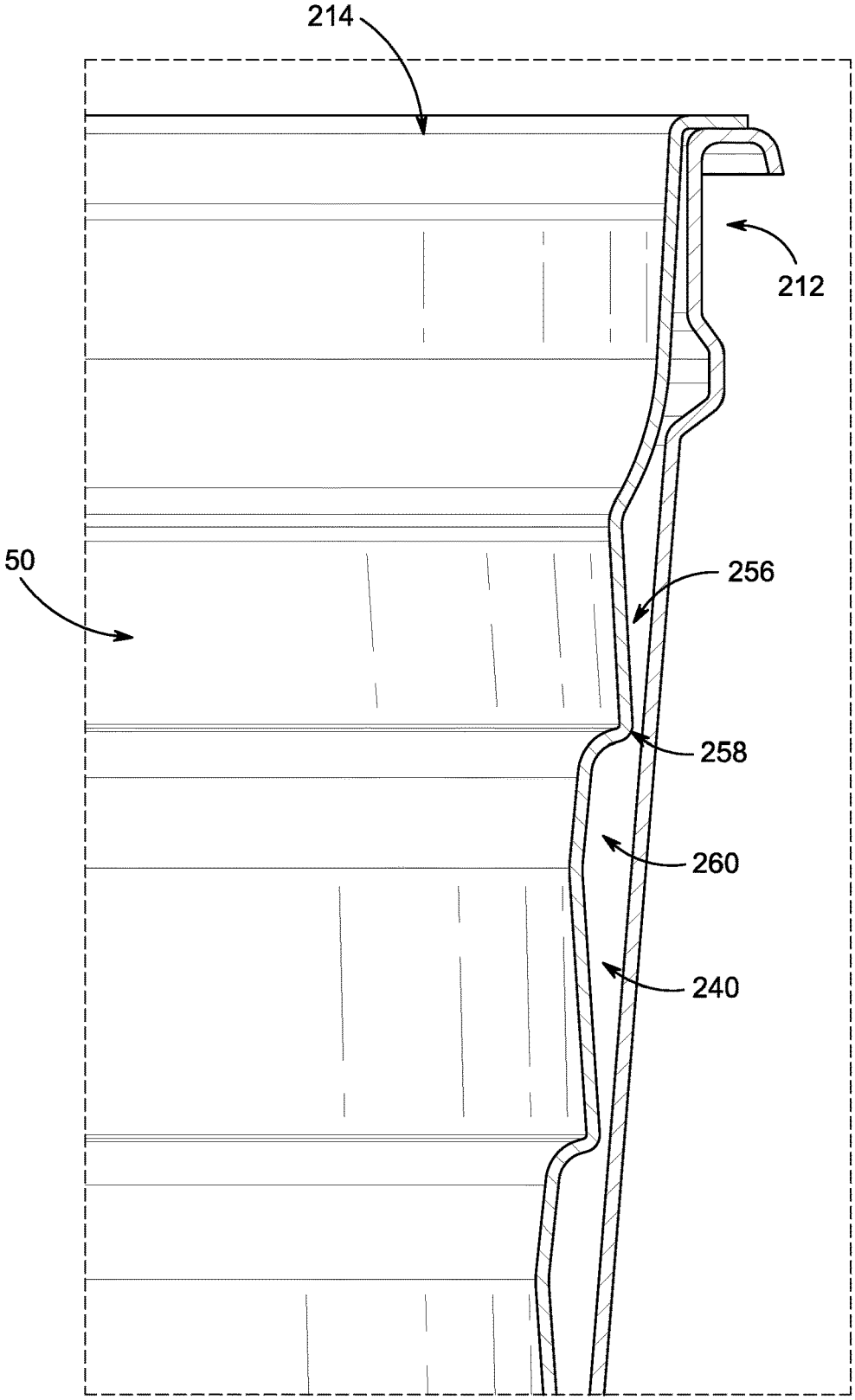
Figure 19:
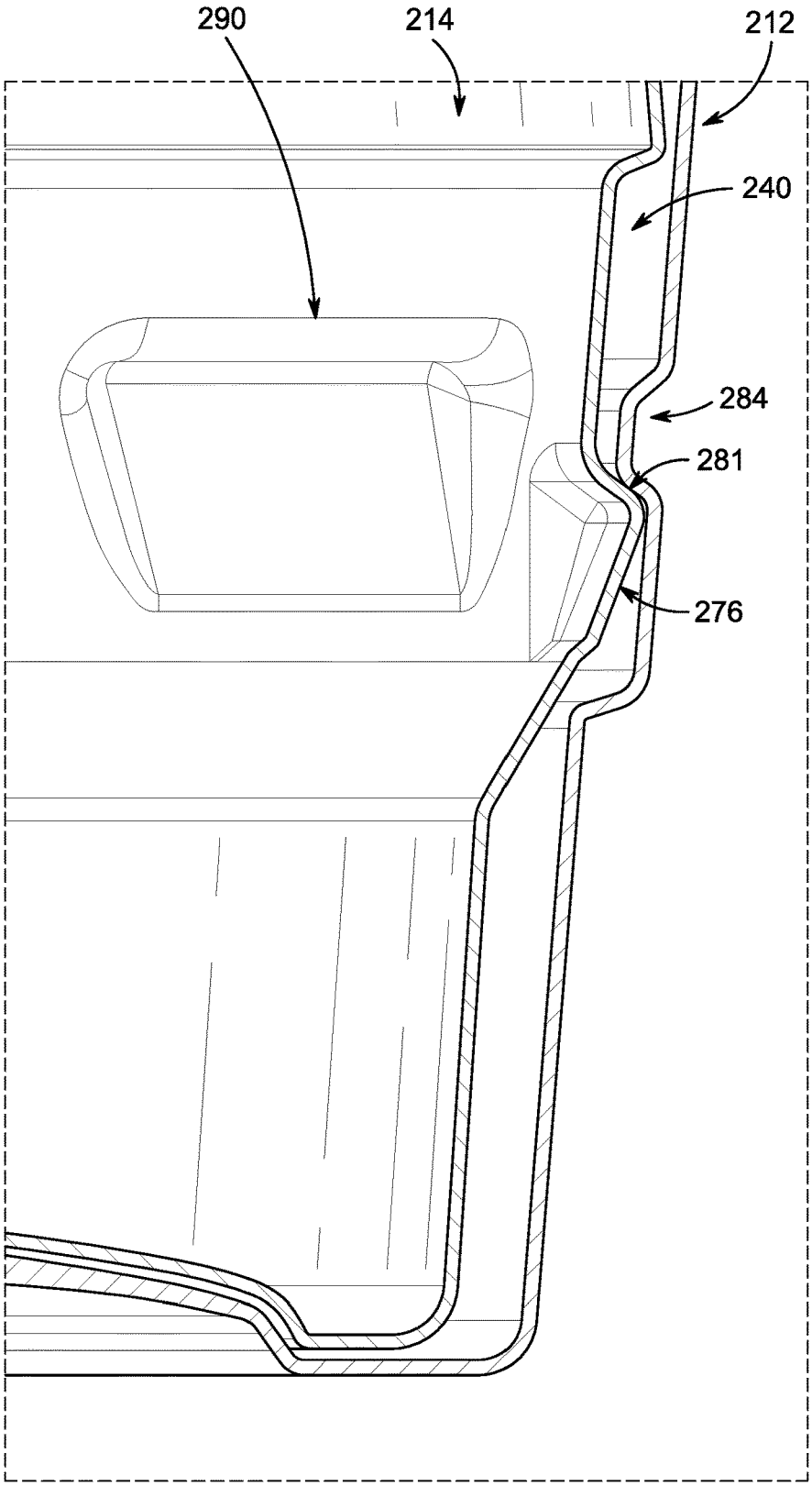
Figure 20:
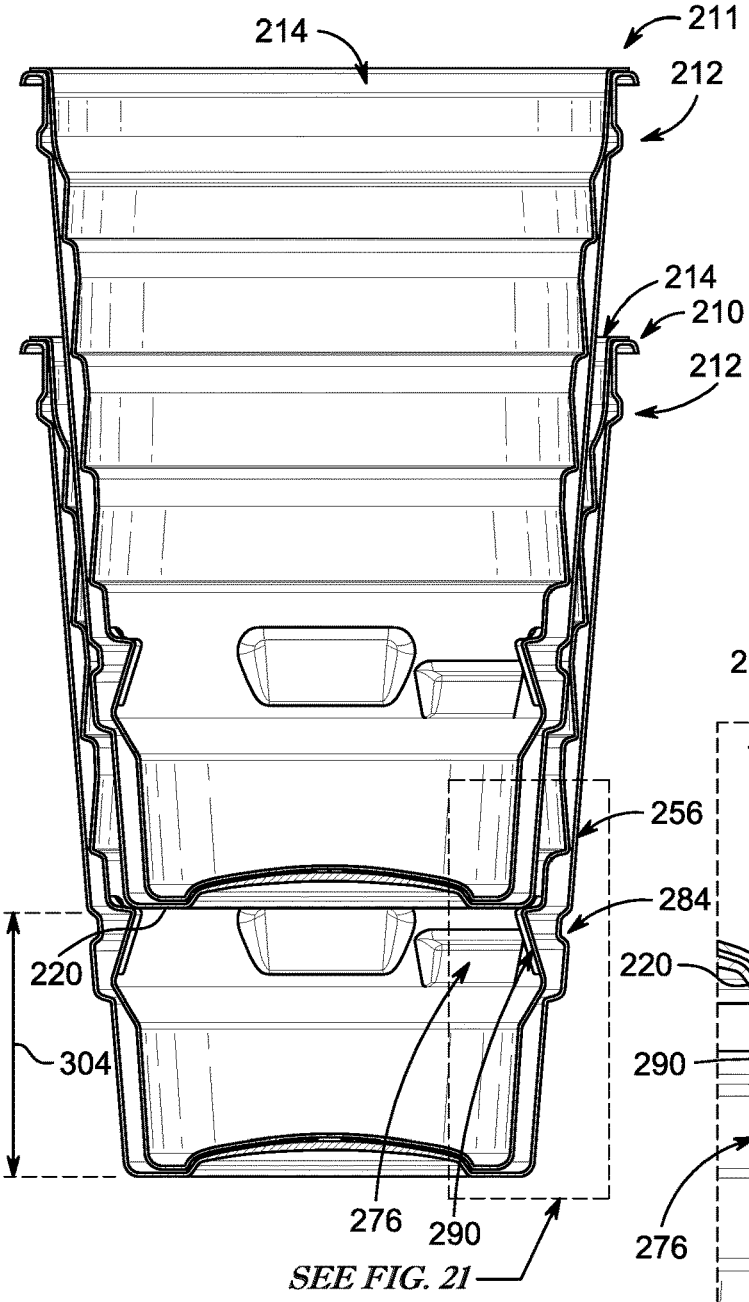
Figure 21:
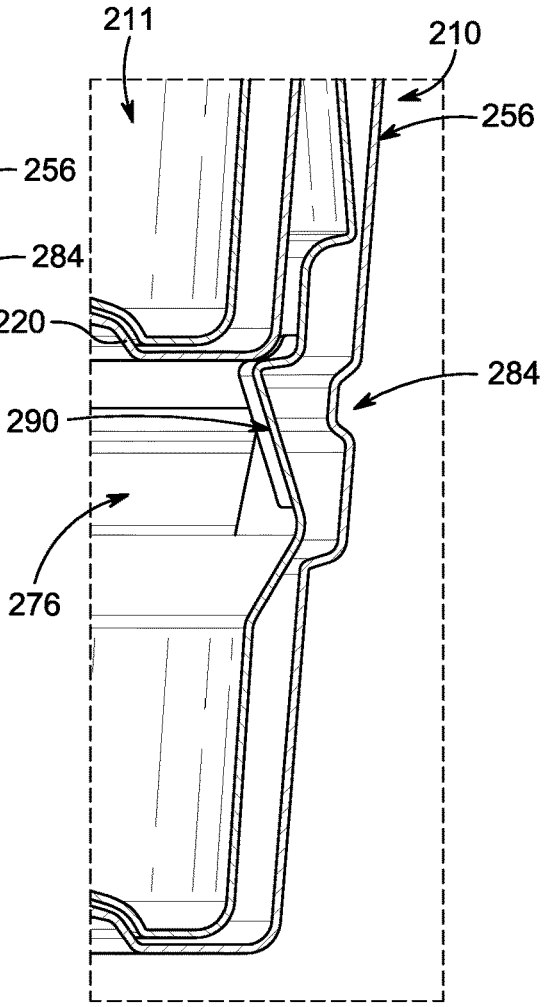
Figure 22:
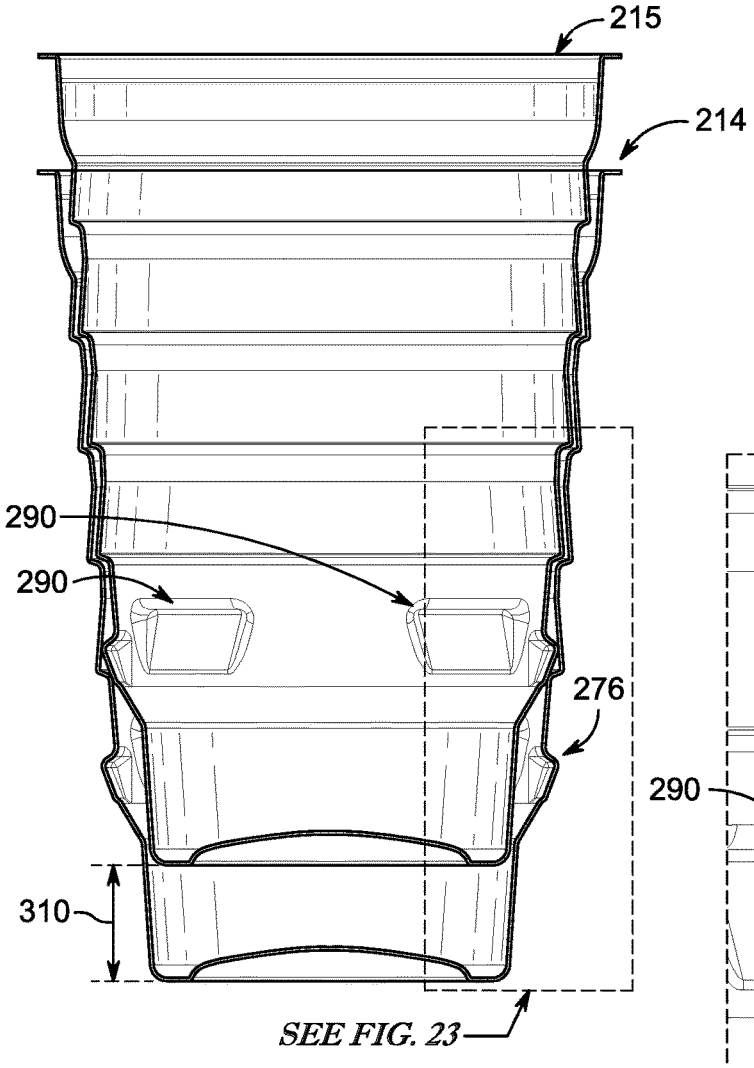
Figure 23:
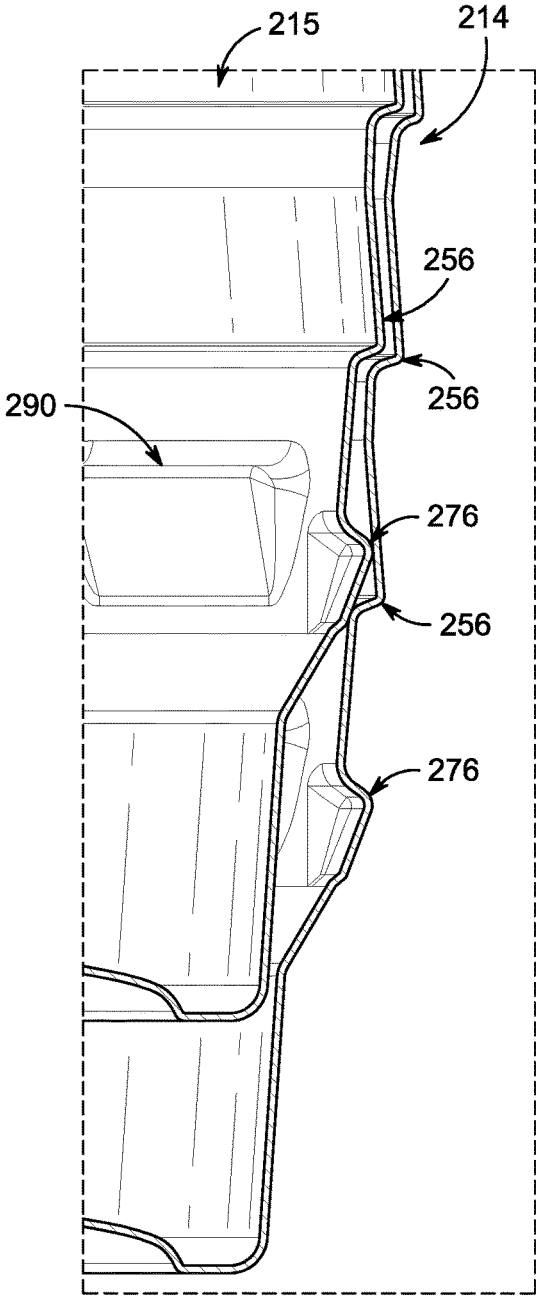
Figure 24:
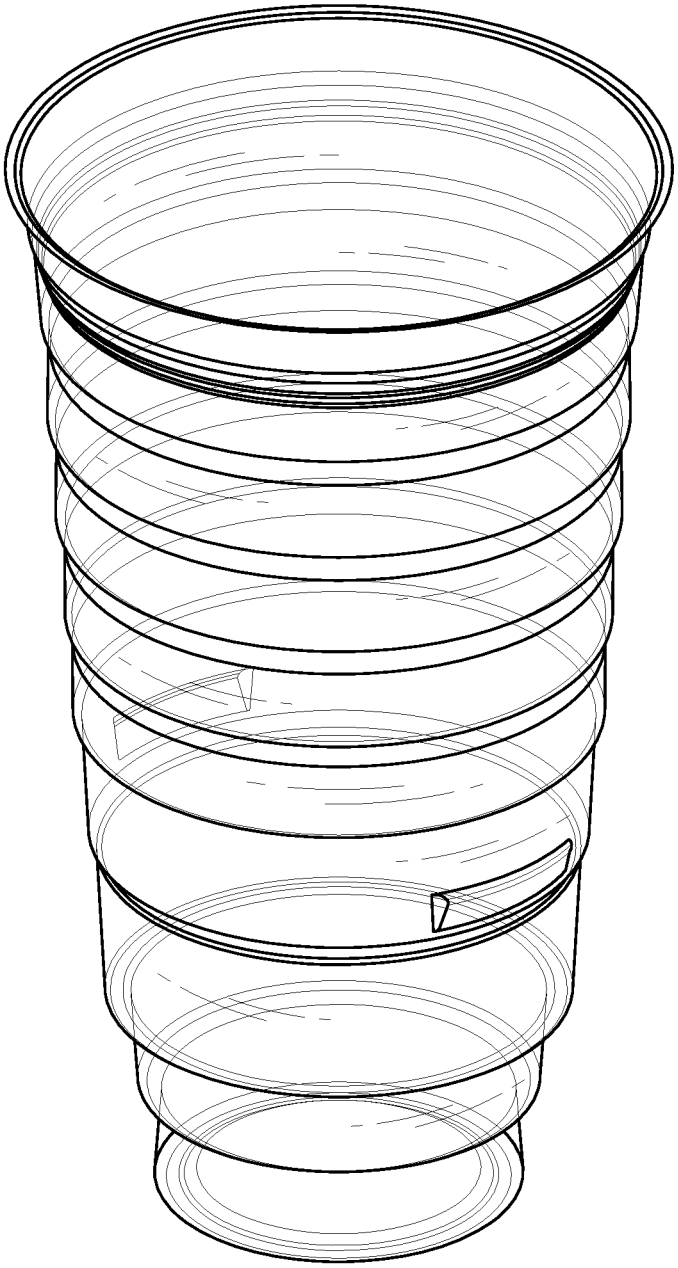
Figure 25:
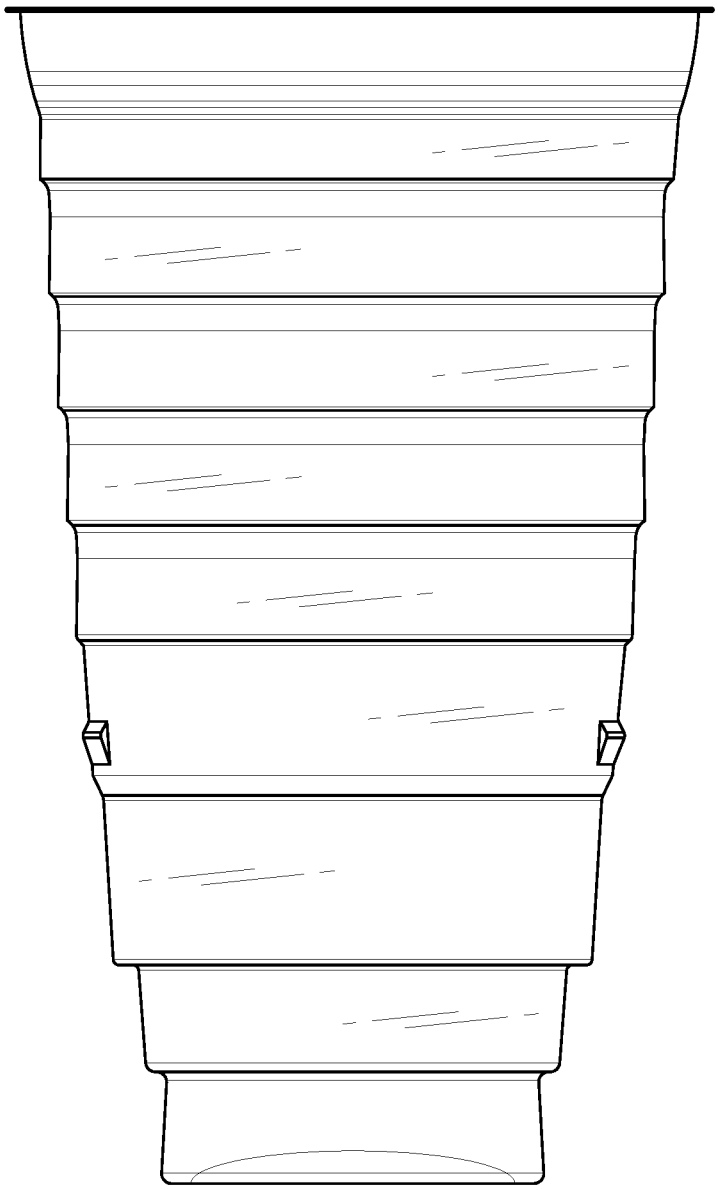
Figure 26:
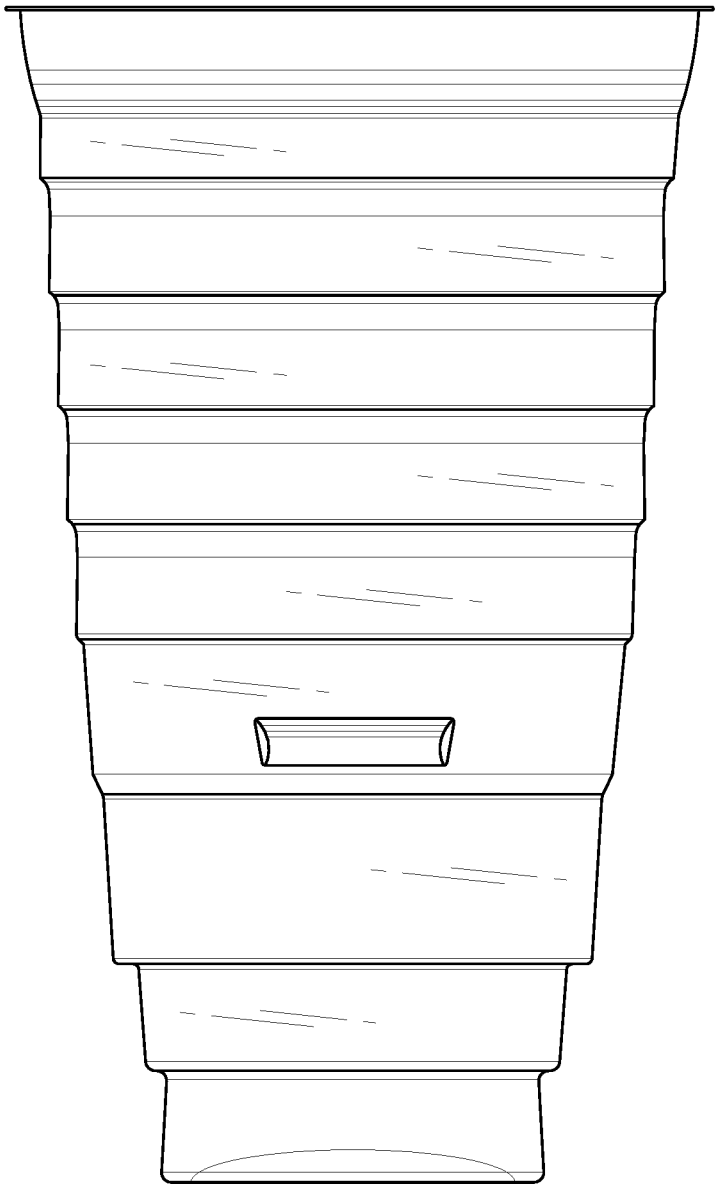
Figure 27:
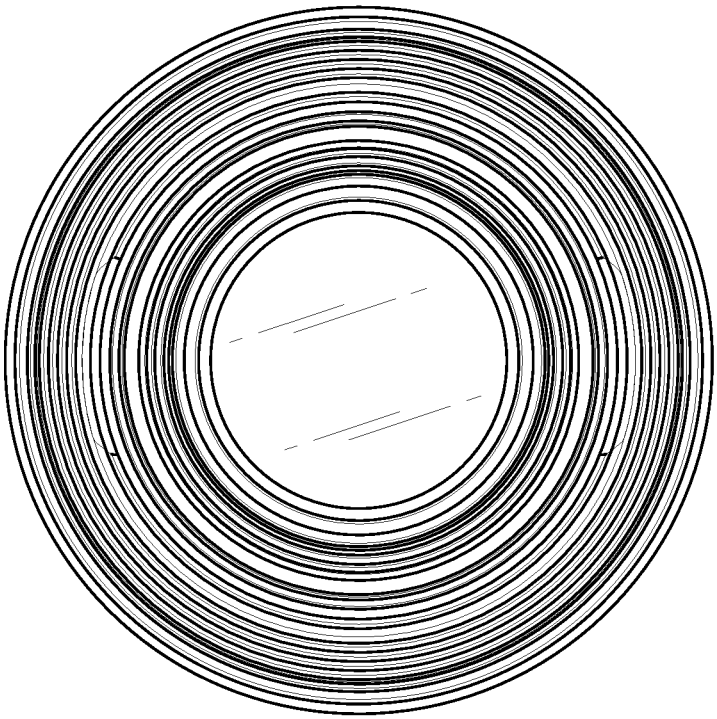
Figure 28:
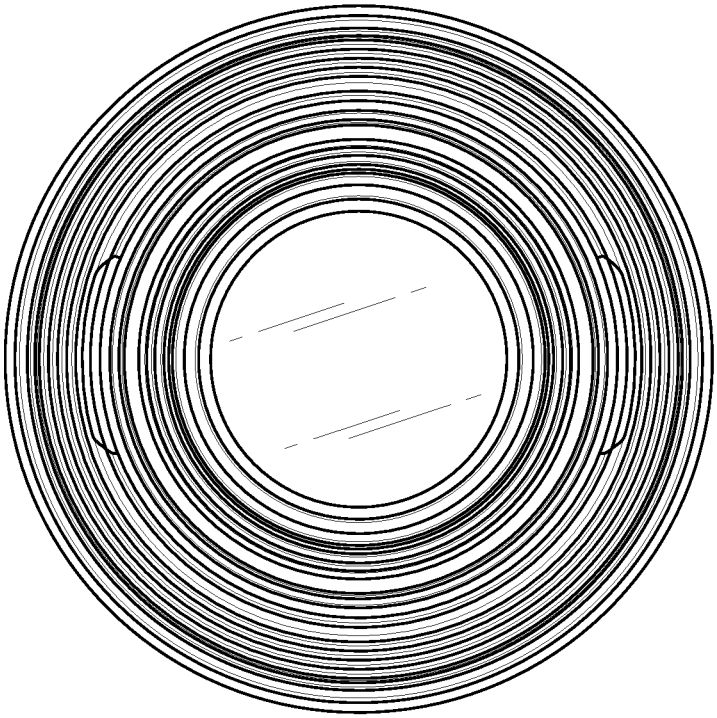
Figure 29:
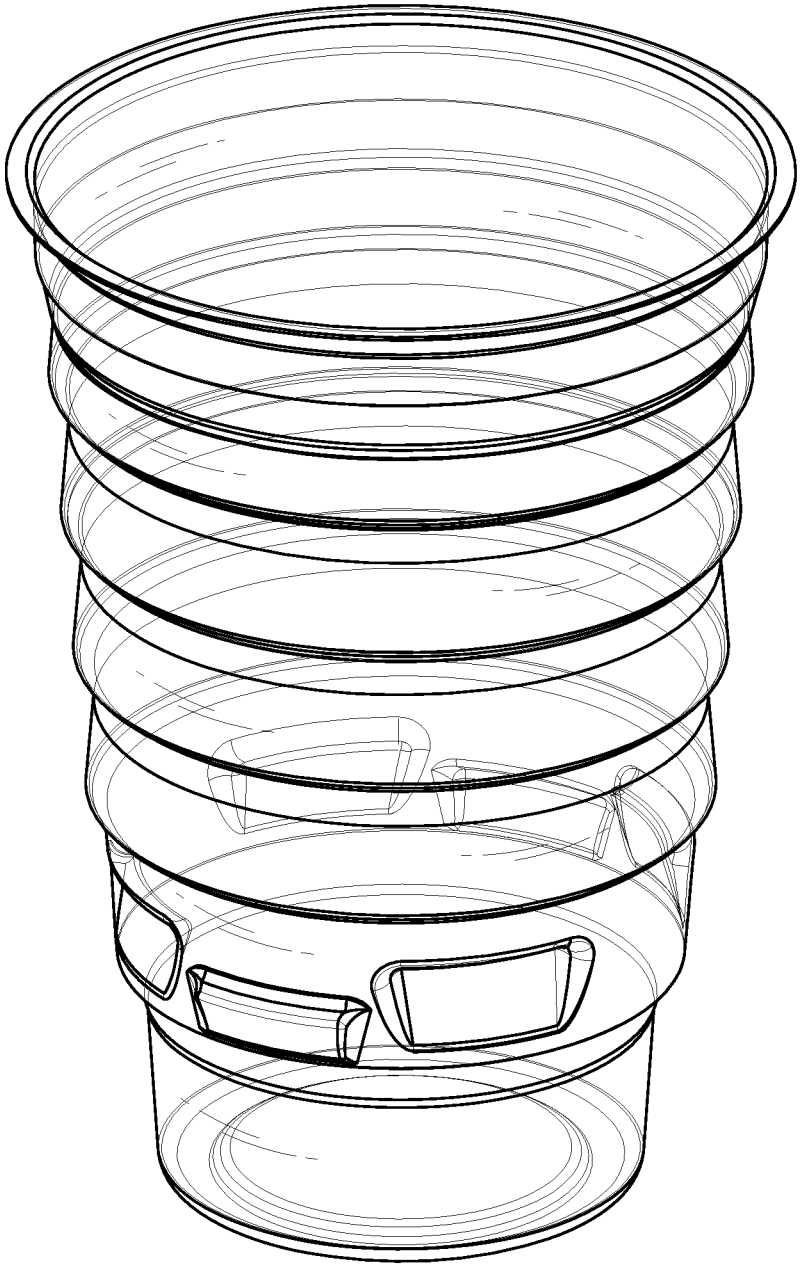
Figure 30:
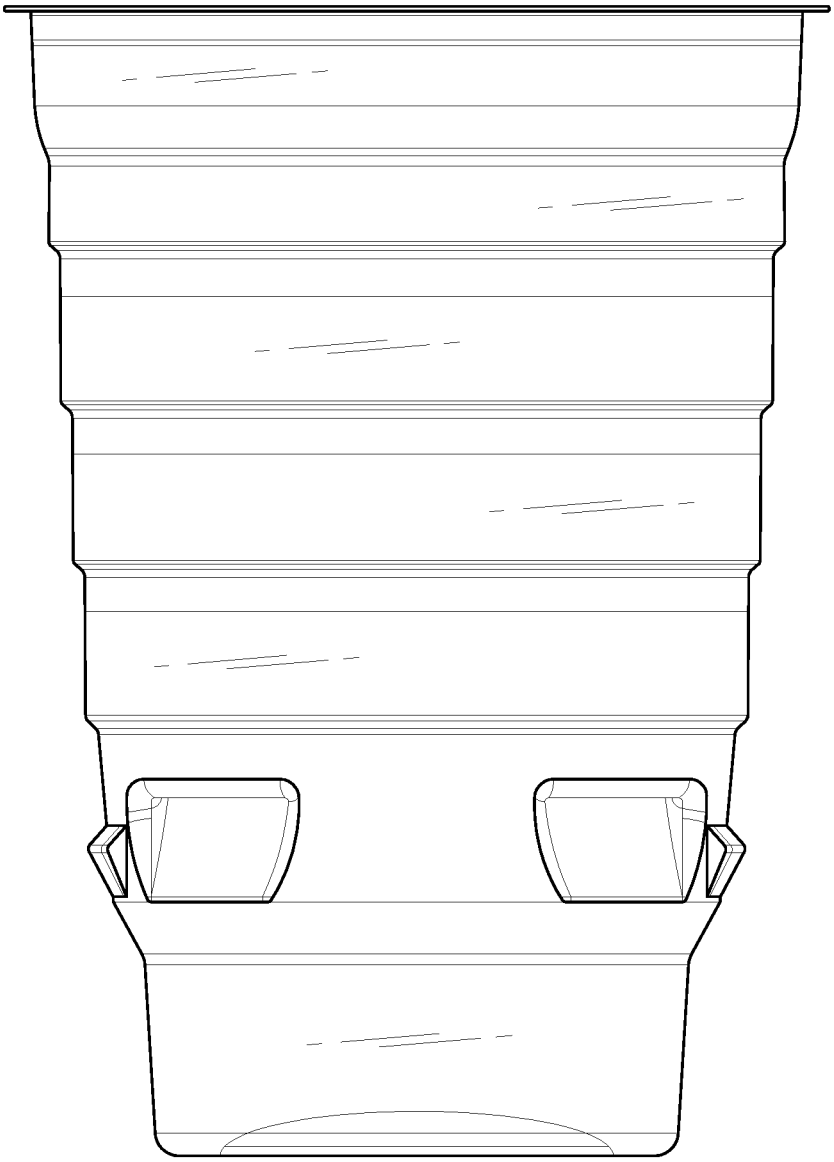
Figure 31:
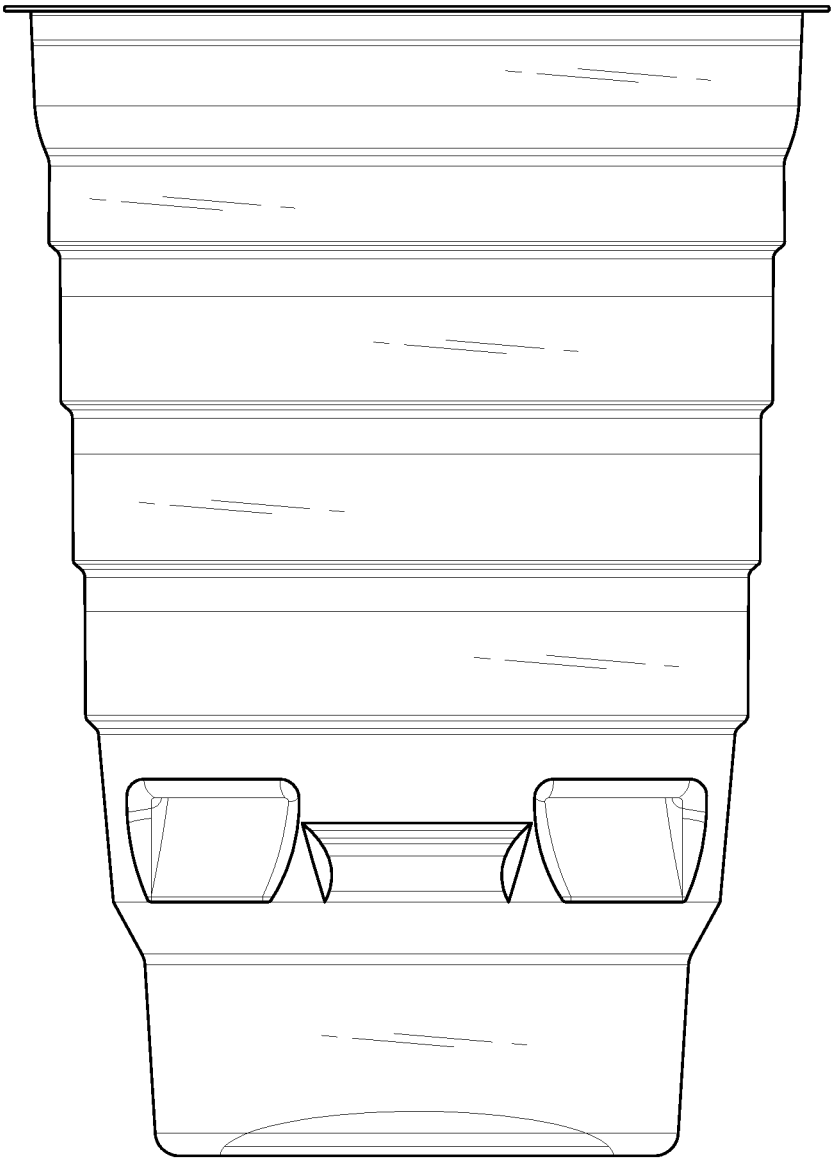
Figure 32:
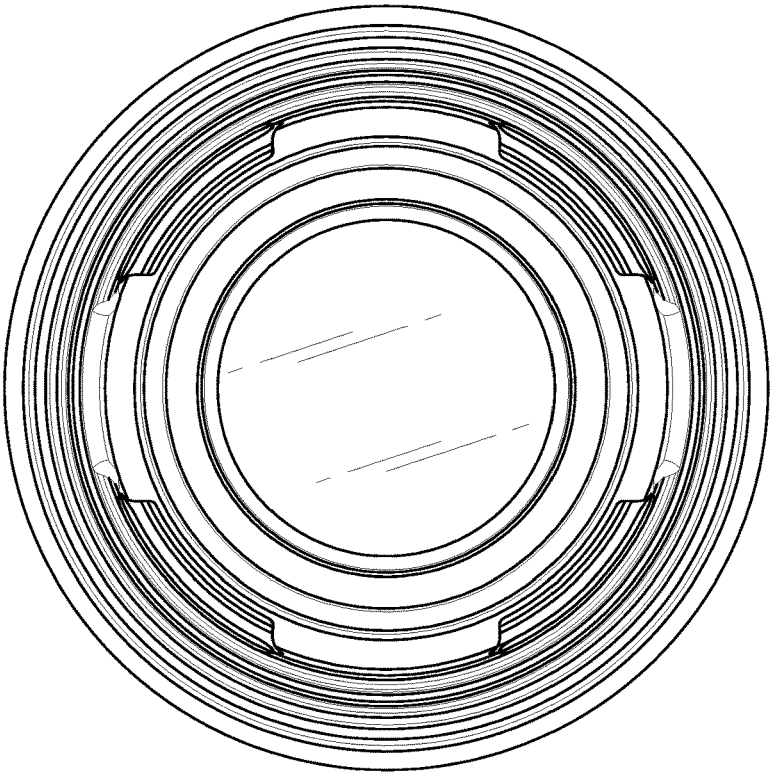
Figure 33:
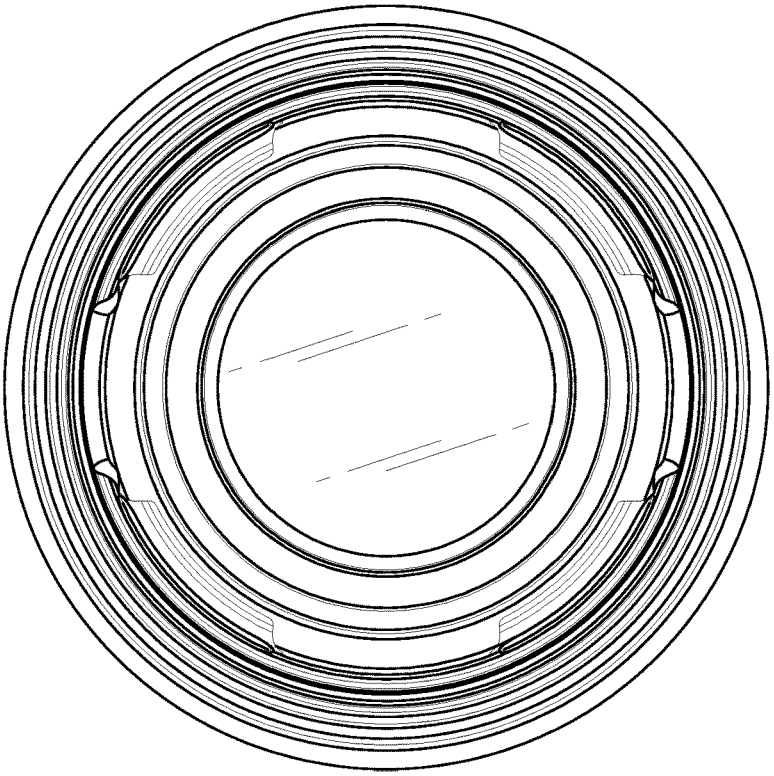
Figure 34:
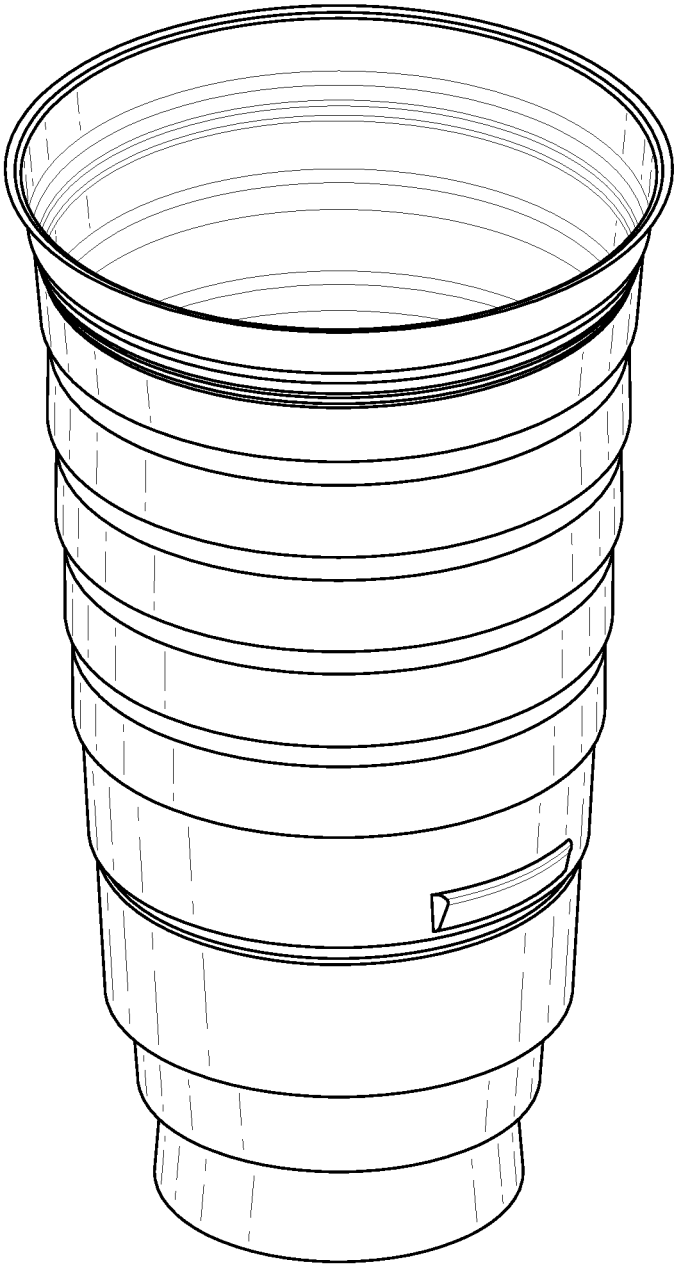
Figure 35:
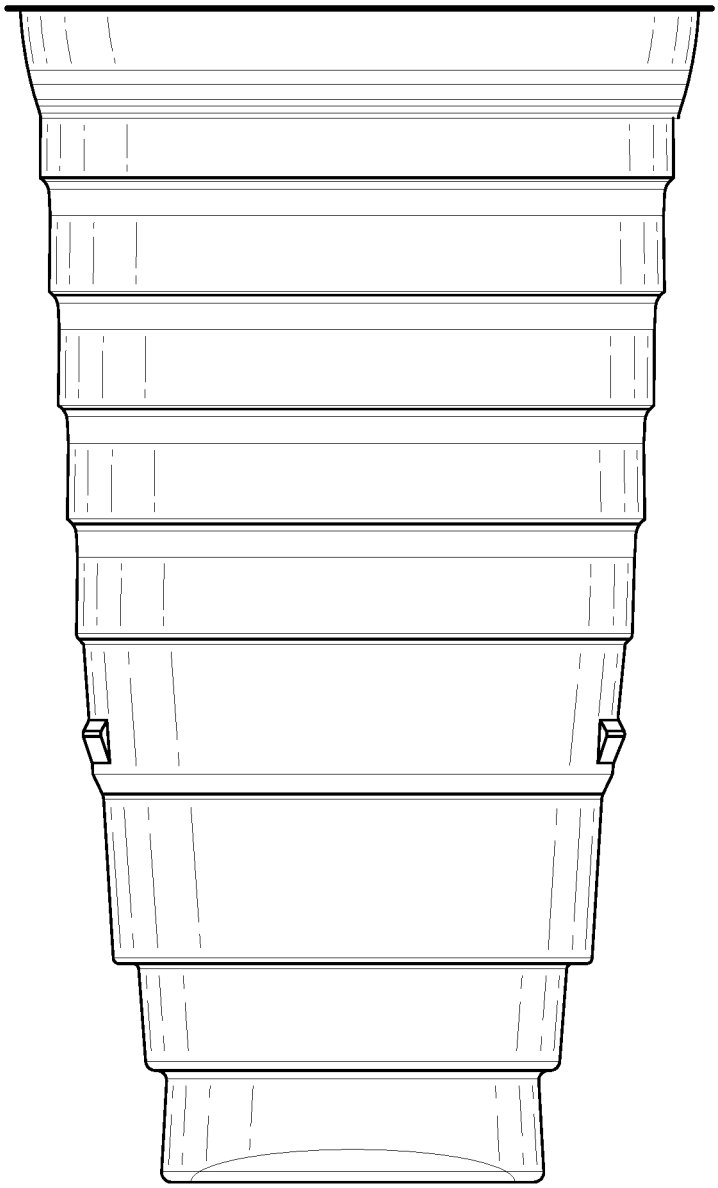
Figure 36:
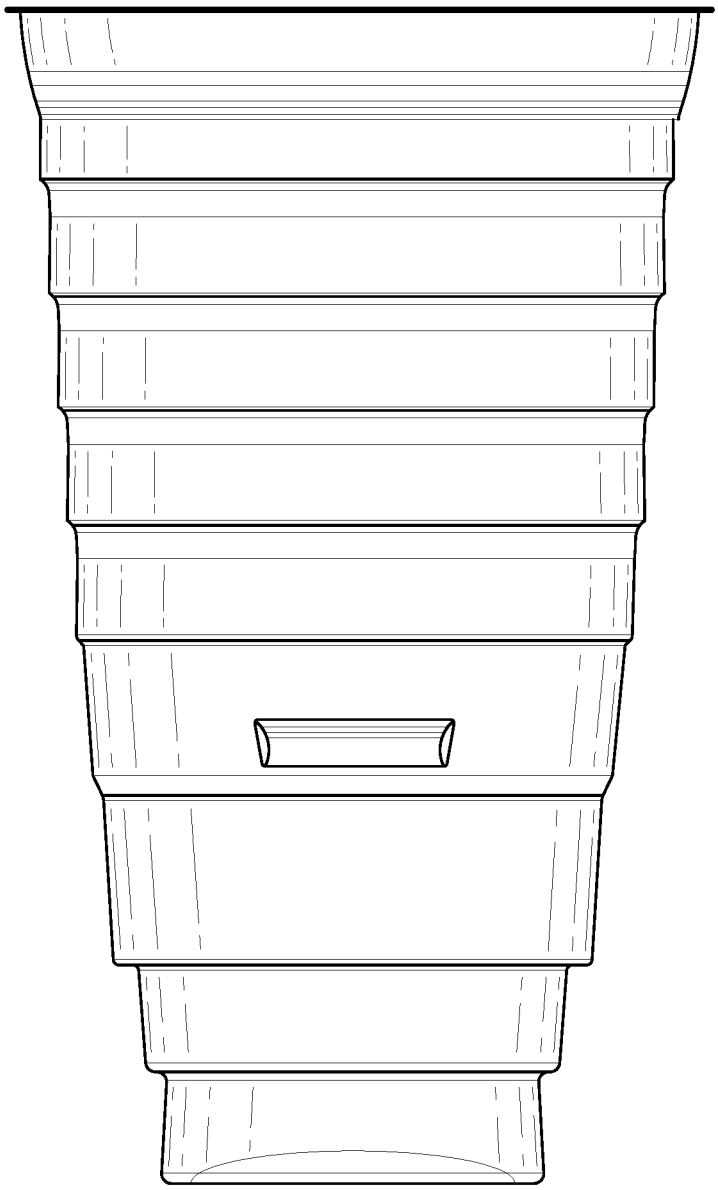
Figure 37:
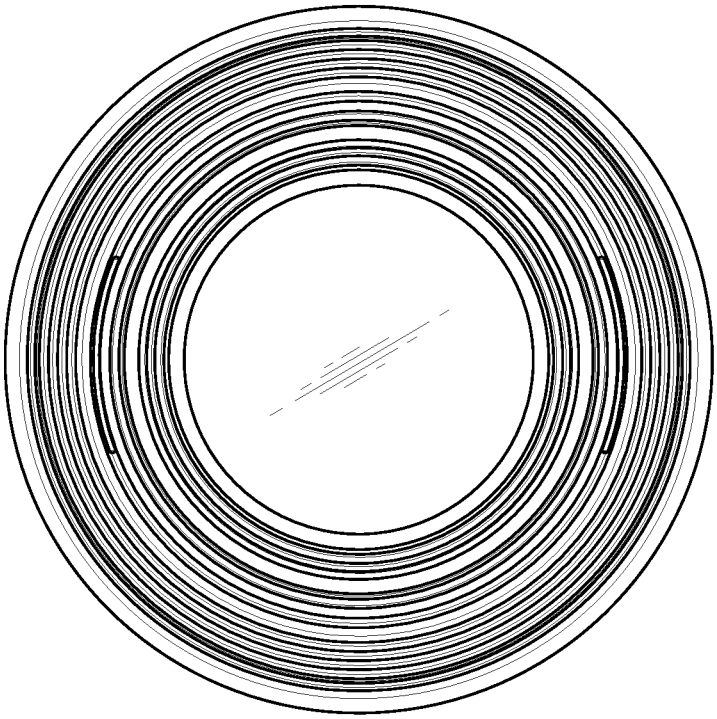
Figure 38:
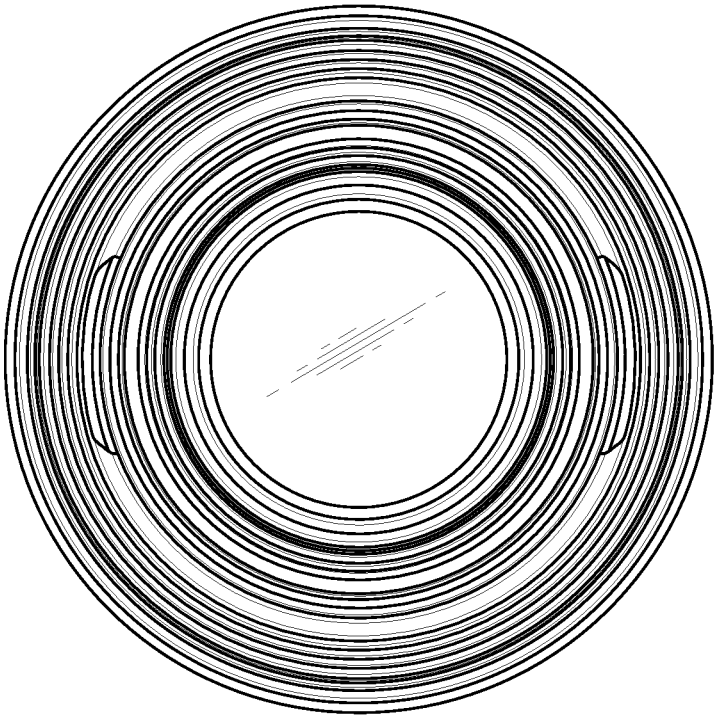
Figure 39:
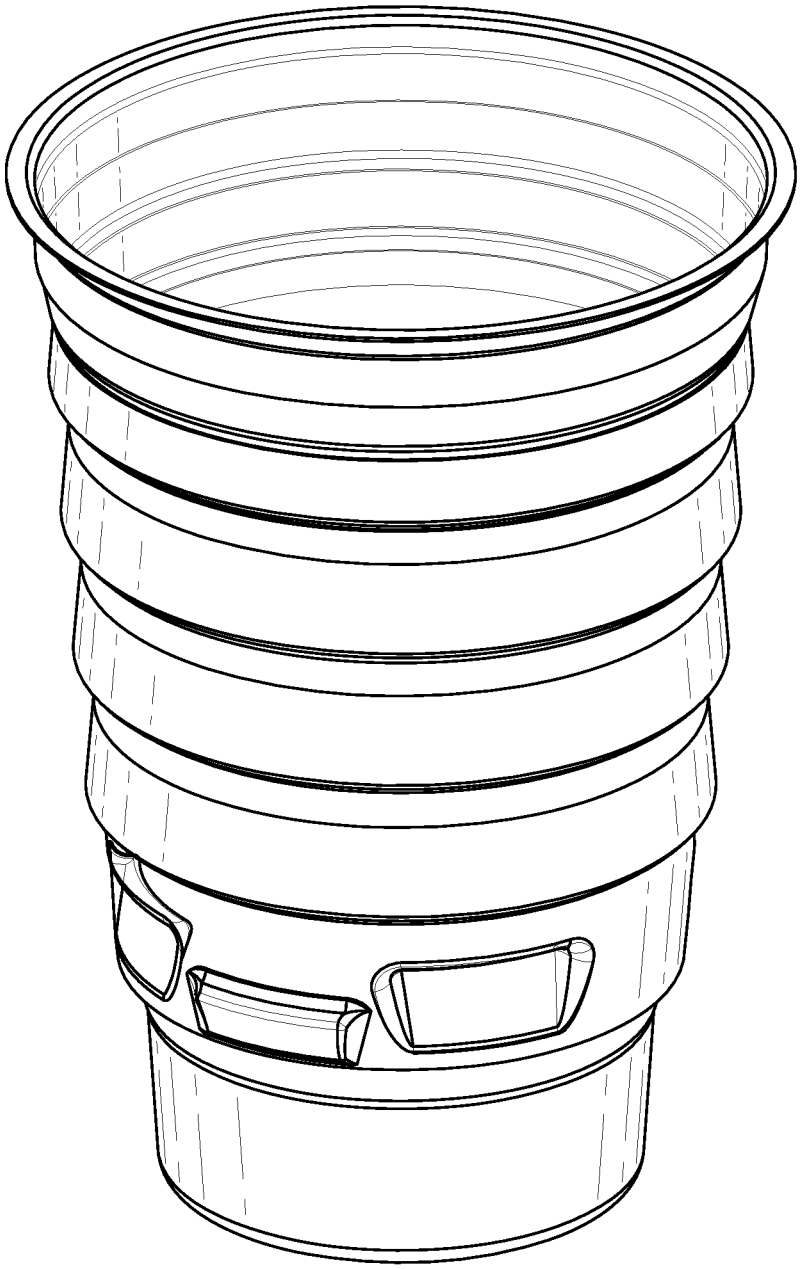
Figure 40:
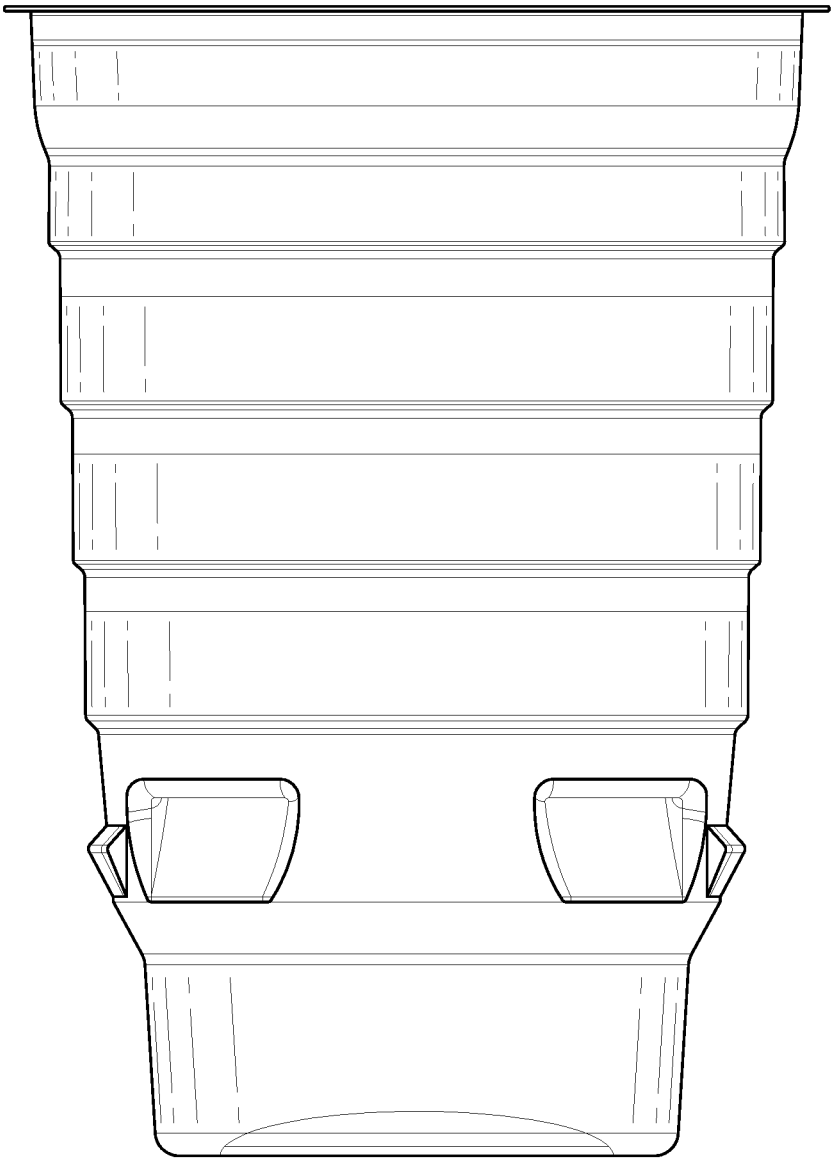
Figure 41:
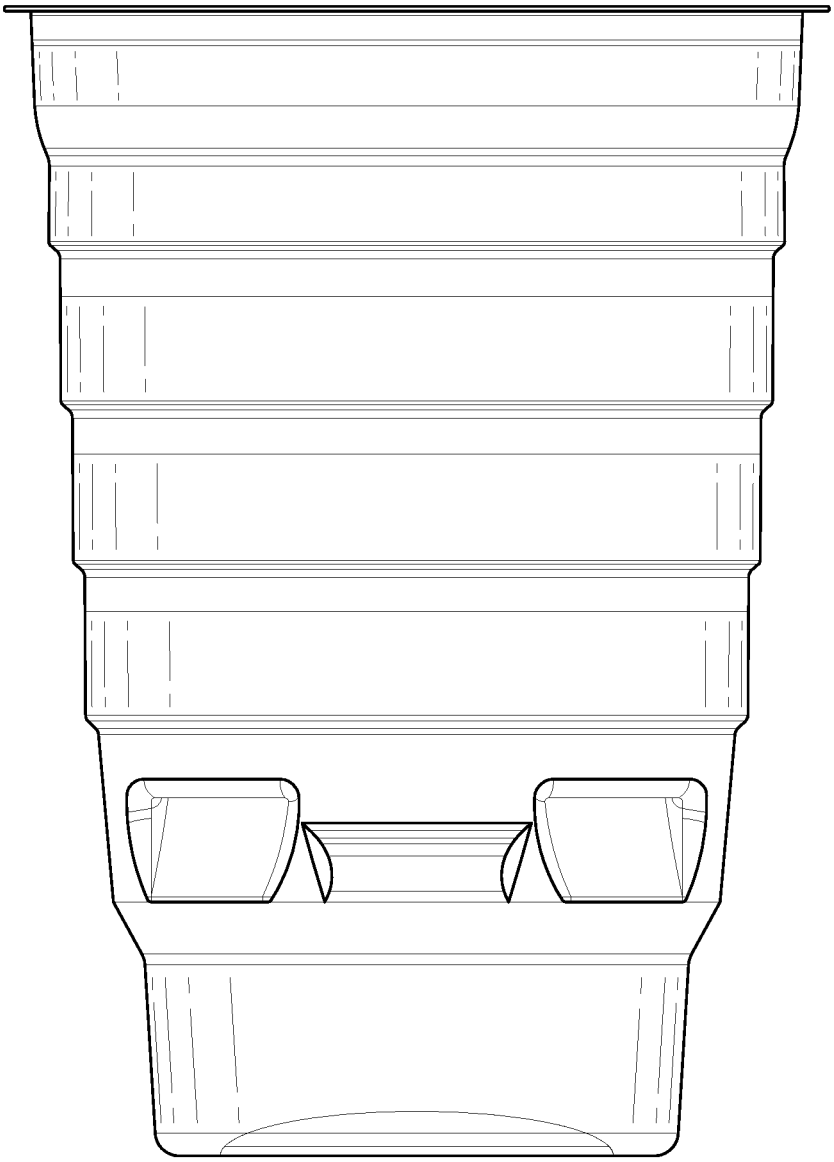
Figure 42:
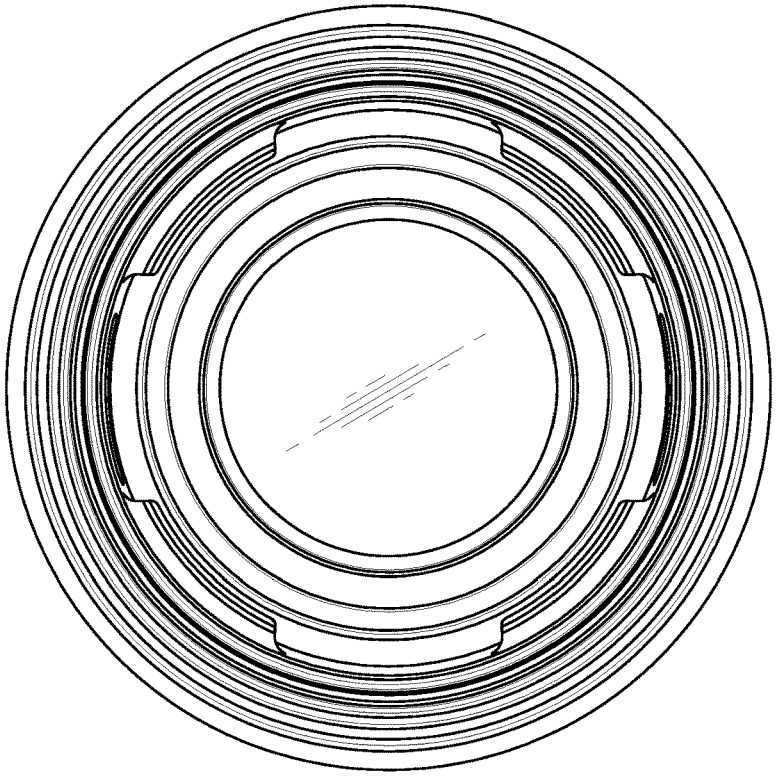
Figure 43:
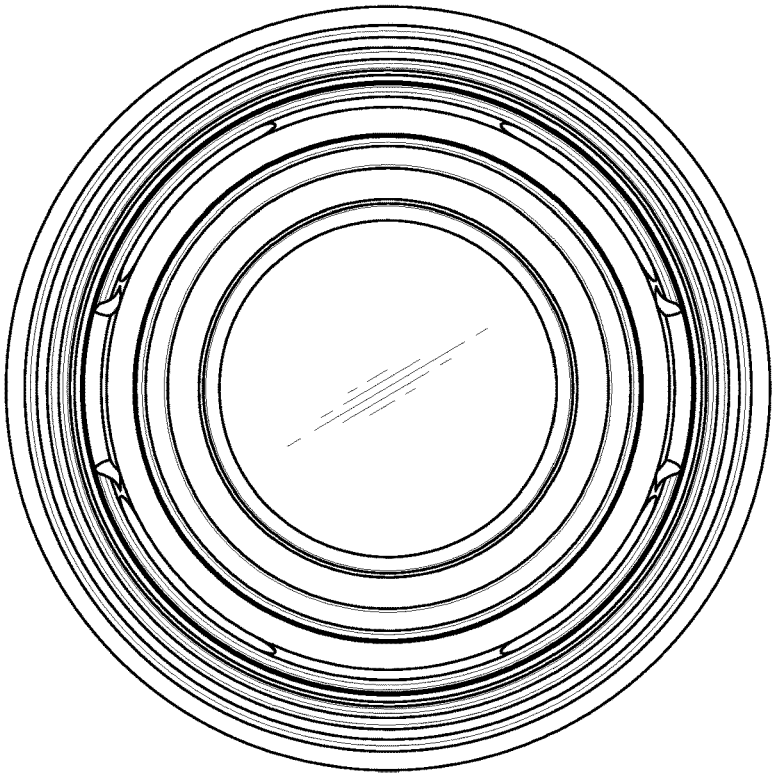
Figure 44:
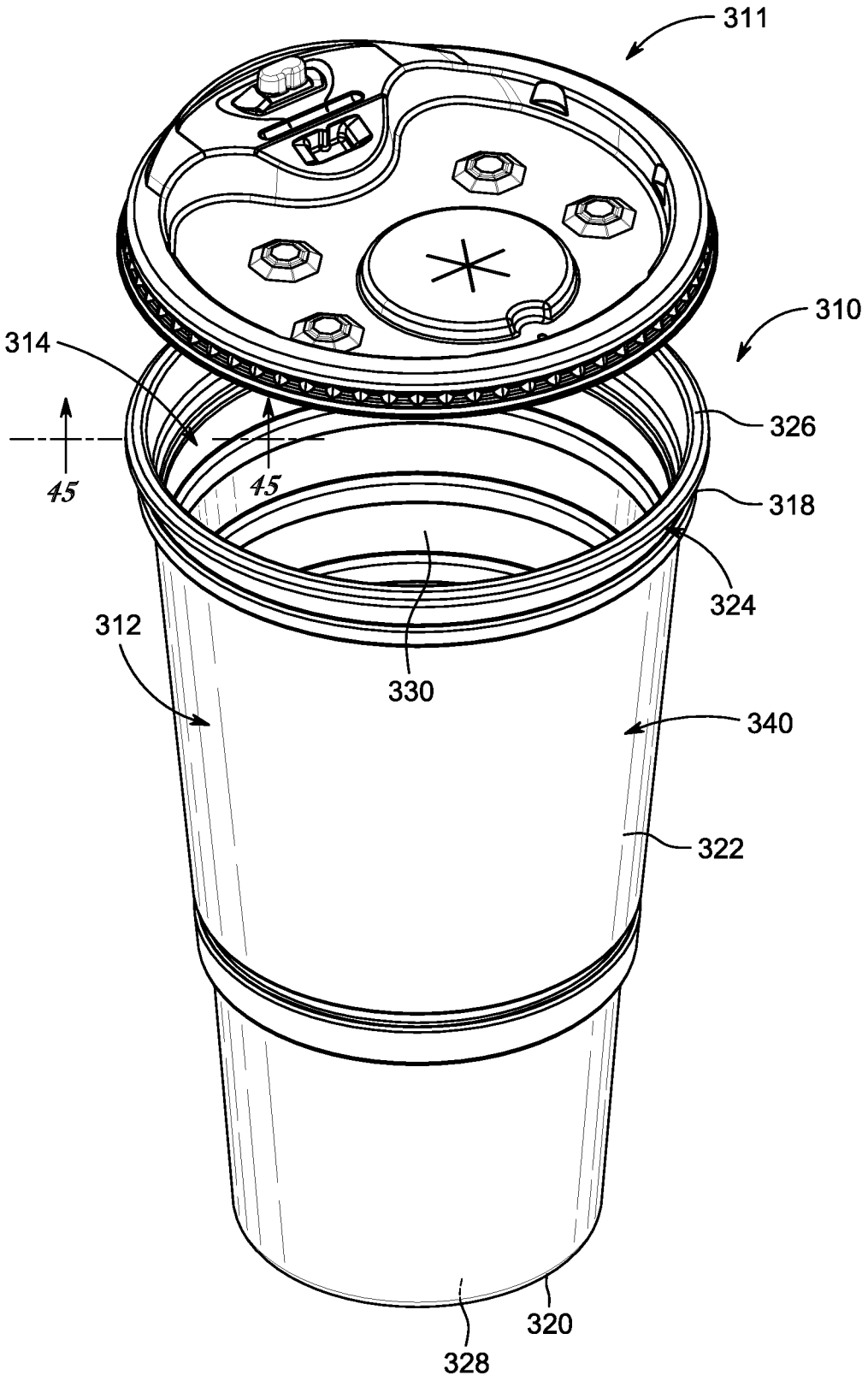
Figure 45:
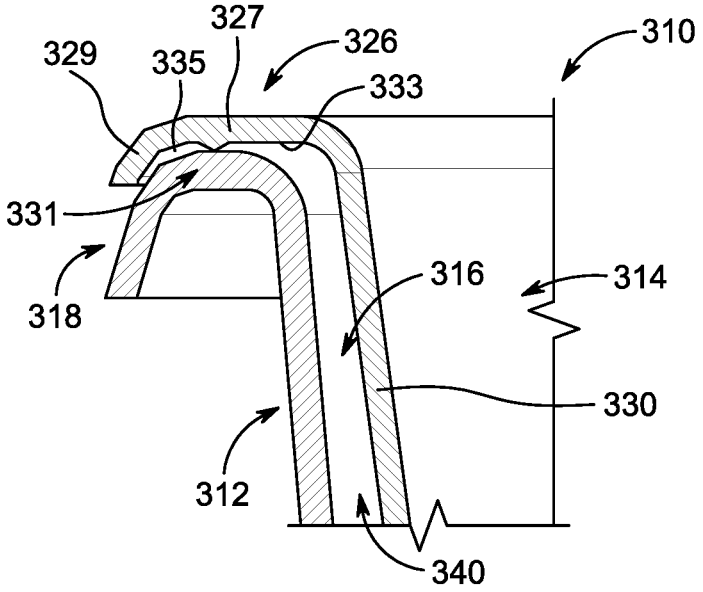
Figure 46:
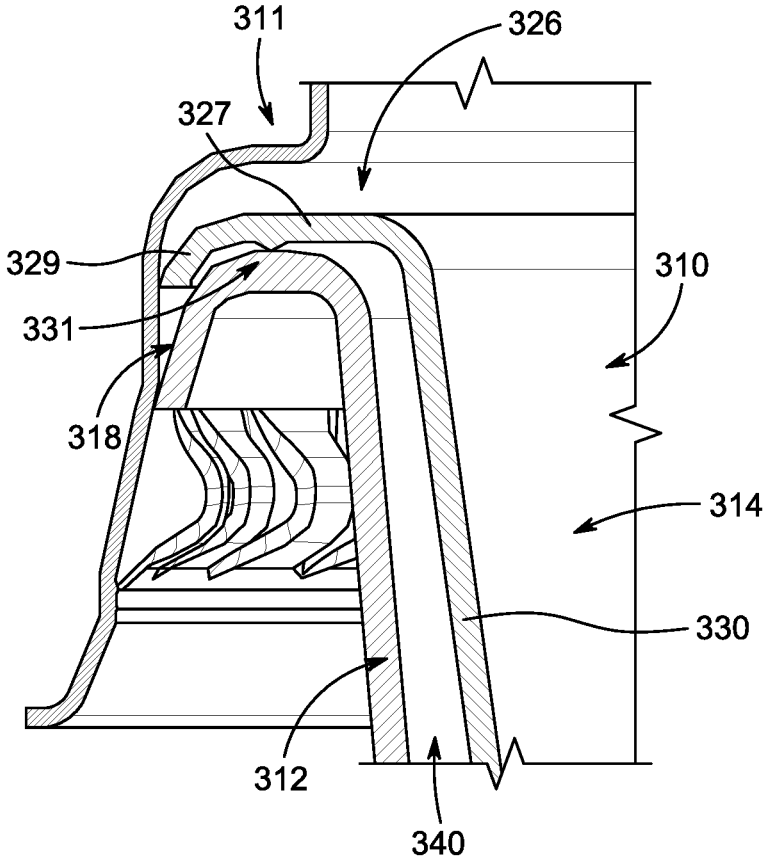
Figure 47:
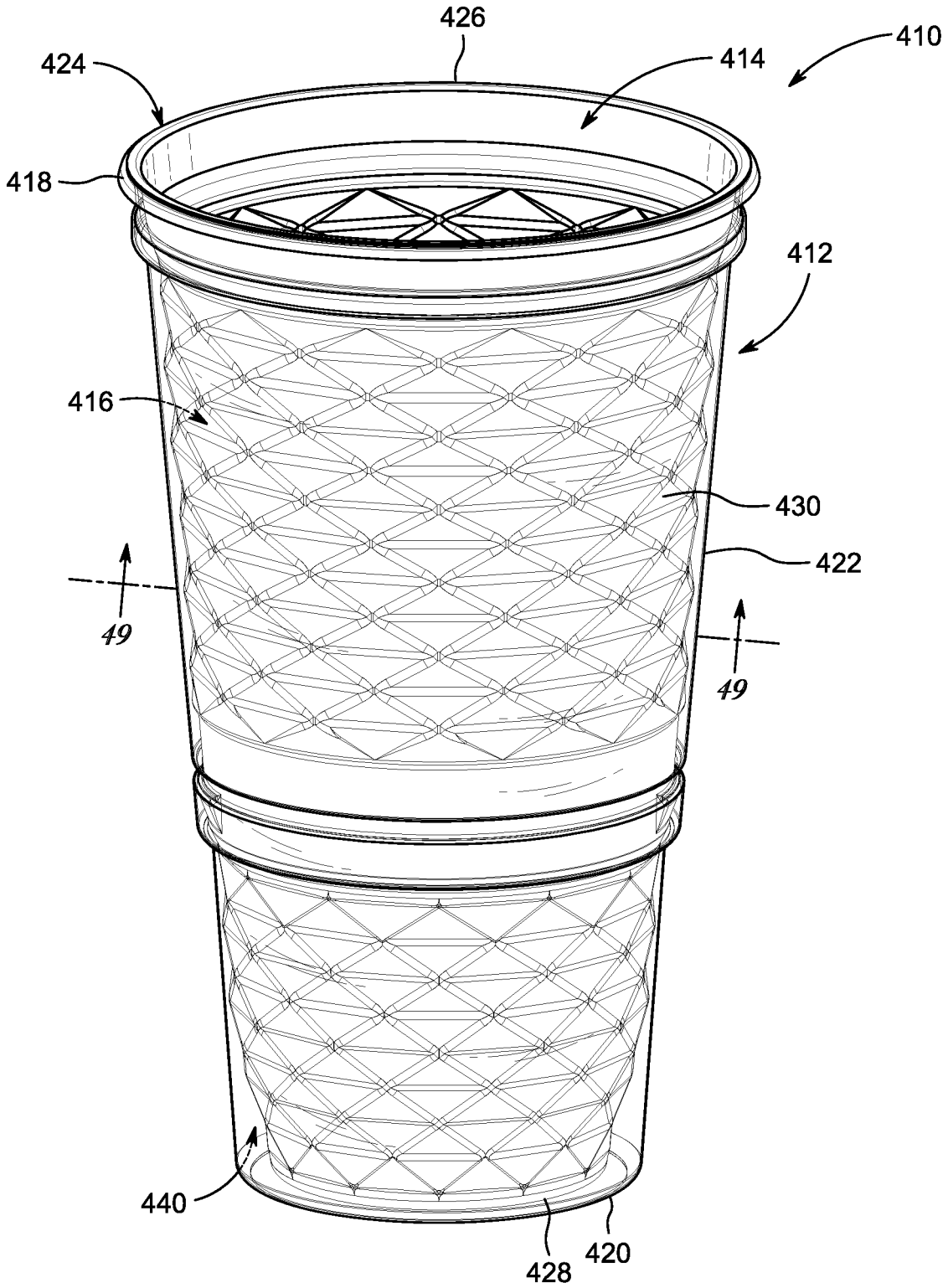
Figure 48:
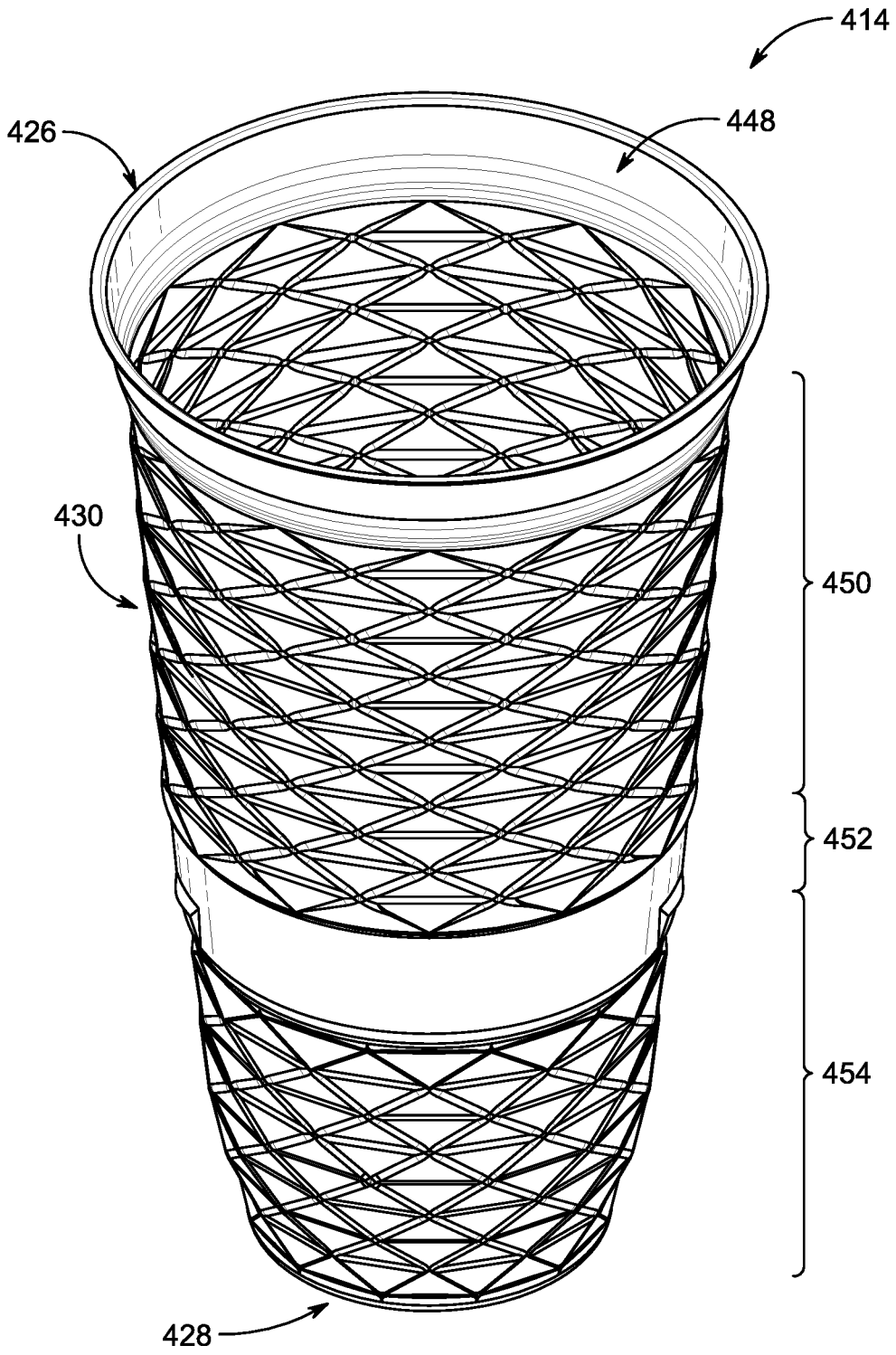
Figure 49:
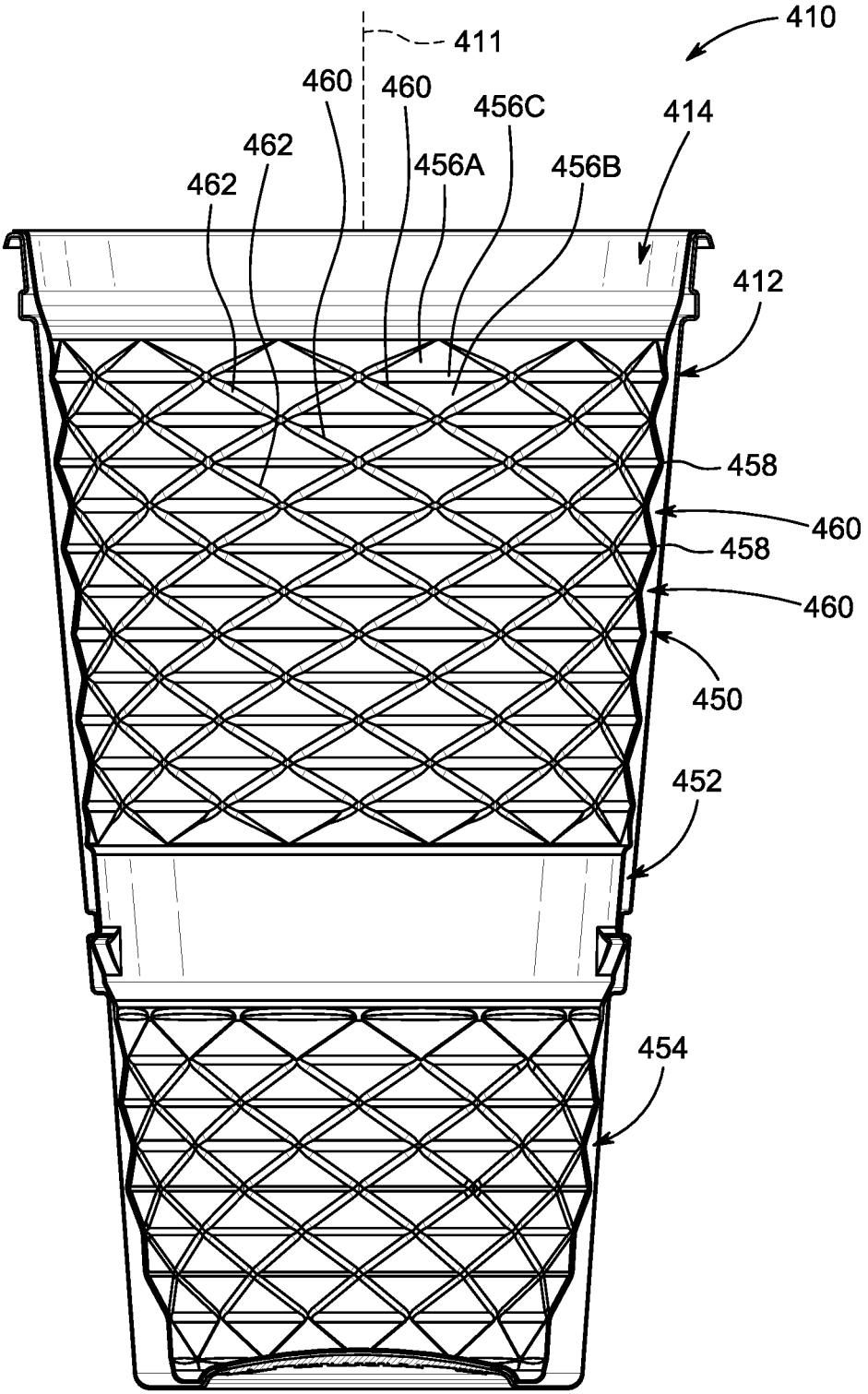
Figure 50:
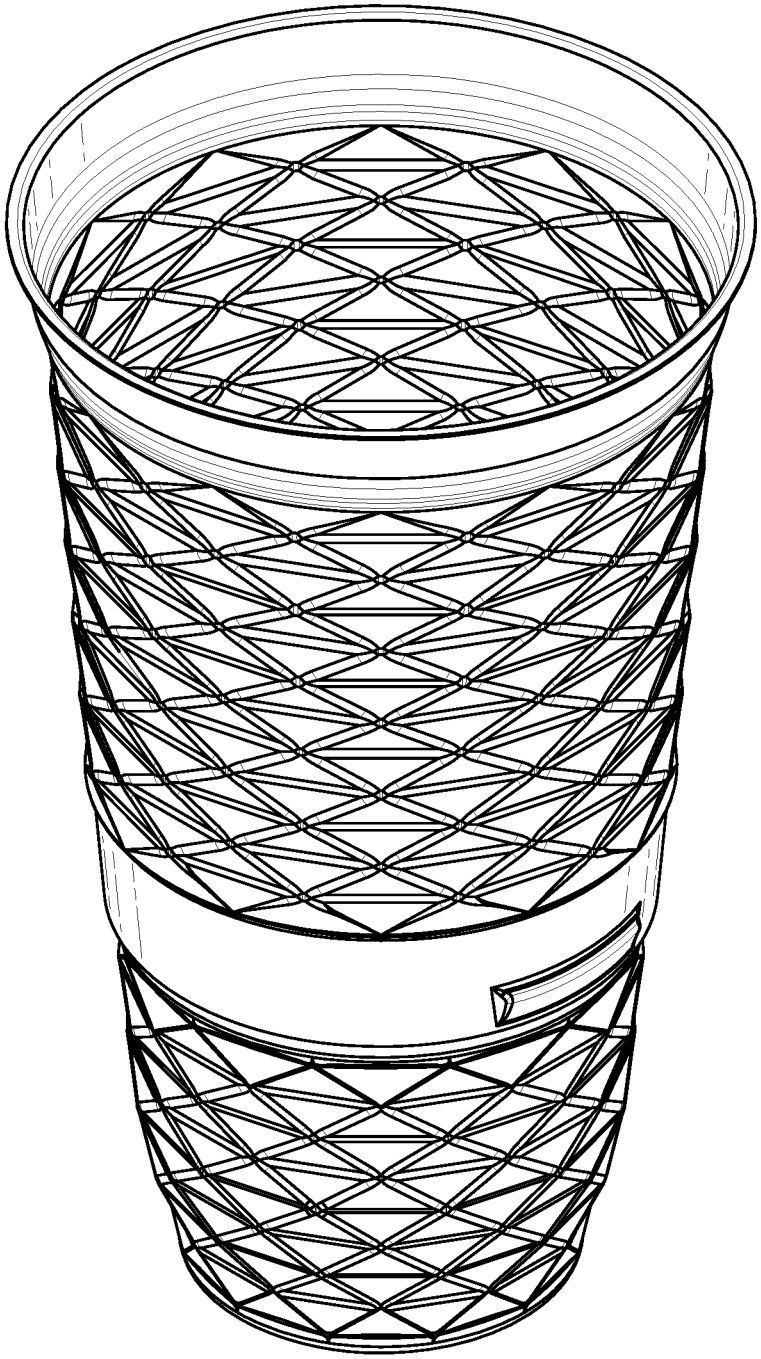
Figure 51:
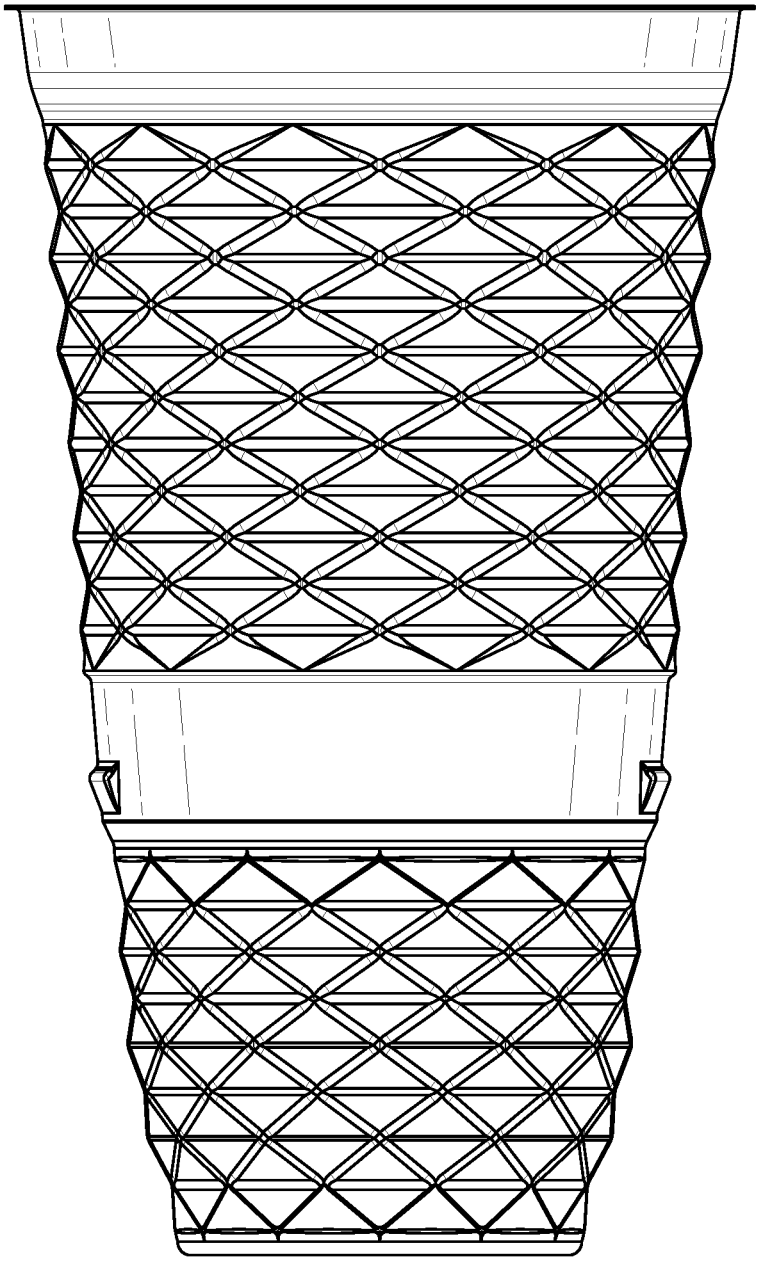
Figure 52:
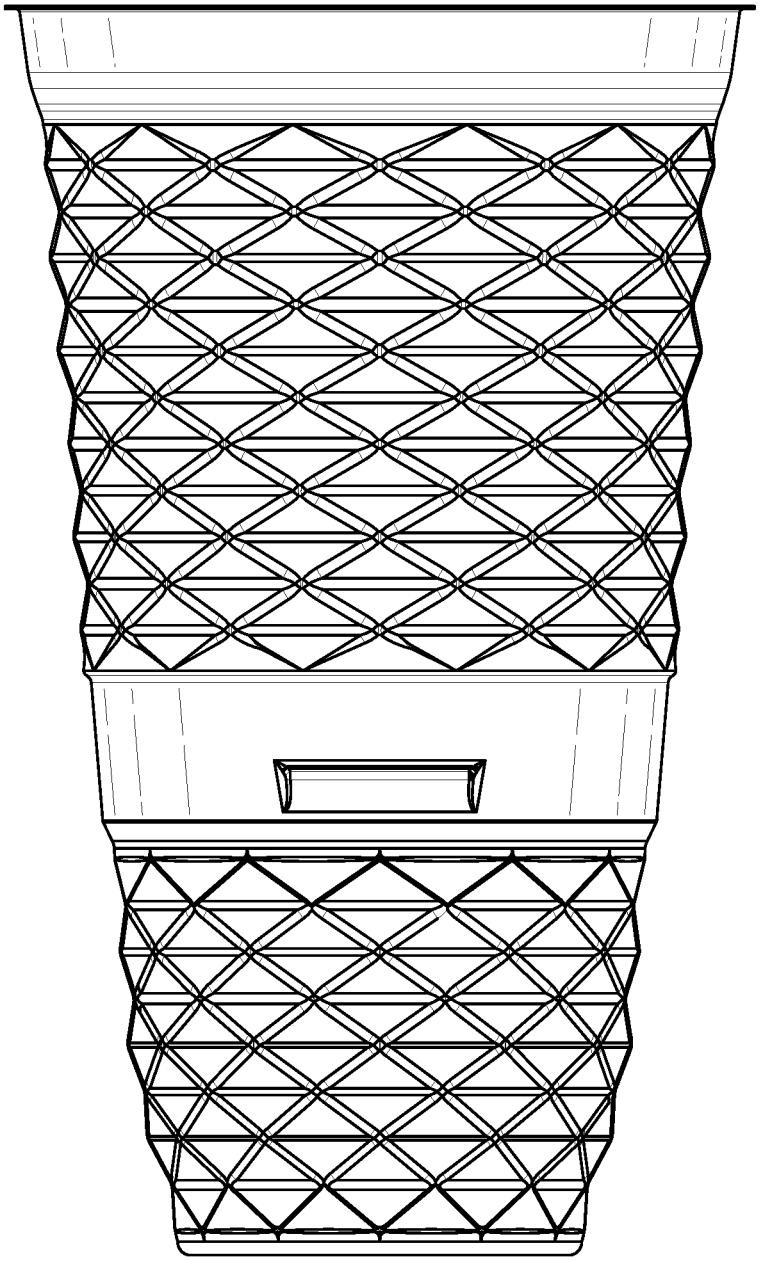
Figure 53:
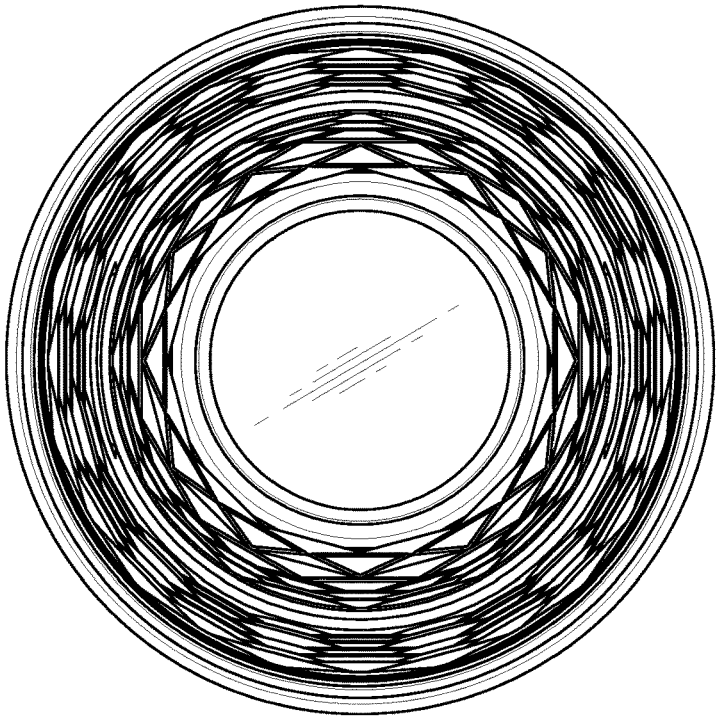

FIG. 8 is an enlarged portion of FIG. 7 showing that the inner gap support includes a stacking shoulder that has a shoulder diameter that is less than a floor diameter of the outer cup to limit how far the top beverage container may be inserted into the bottom beverage container to block interaction between the plurality of spacer ribs of the bottom beverage container with the outwardly-projecting ridge of the outer cup of the top beverage container so that removal of the top beverage container from the bottom beverage container is facilitated;

FIG. 9 is a sectional view of a top gap support stacked within an identical bottom gap support for storage and/or transport;

FIG. 10 is an enlarged portion of FIG. 9 showing that each inner gap support includes a stacking shoulder that has a shoulder diameter that is less than a floor diameter of the gap support to limit how far the top gap support may be inserted into the bottom gap support to block interaction between the plurality of spacer ribs of the bottom gap support with the plurality of retainer tabs of the top gap support;

FIG. 11 is a graph showing testing data comparing content temperature within the beverage container of the illustrative embodiment to other containers over time;

FIG. 12 is a chart showing a duration of time that each container from FIG. 11 was able to maintain its contents below 50 degrees Fahrenheit;

FIG. 13A is a graph showing testing data comparing condensation on the beverage container of the illustrative embodiment to other container over time;

FIG. 13B is another chart showing an amount of condensation formed on each container after a duration of about 90 minutes;

FIG. 14 is a perspective view of a second embodiment of a beverage container, in accordance with the present disclosure, with portions broken away to show that the beverage container includes an outer cup and an inner gap support that is sized to fit within an interior space of the outer cup to establish an insulative air-gap radially between the outer cup and the inner gap support relative to a central axis of the beverage container, as shown in FIG. 13, so that the beverage container may be filled with hot or cold liquids while insulating the liquids from the outer cup;

FIG. 15 is an exploded assembly view of the second embodiment of the beverage container showing, from top to bottom, the inner gap support and the outer cup, the inner gap support including a gap-support foundation, a gap-support brim, and a gap-support body extending between and interconnecting the gap-support foundation and the gap-support brim, the gap-support body including a plurality of annular spacer ribs and a plurality of gap-support retainer tabs that are configured to interlock with corresponding features on the outer cup to provide a snap-fit interface between the outer cup and the inner gap support when the inner gap support is inserted into the interior space of the outer cup as shown in FIG. 14;

FIG. 16 is a sectional and diagrammatic view taken along line 16-16 in FIG. 14 showing the insulative air-gap radially between the inner gap support and the outer cup maintained by the plurality of annular spacer ribs and showing each of the plurality of gap-support retainer tabs interlocked with a corresponding feature on the outer cup to retain the inner gap support to the outer cup within the interior space of the outer cup;

FIG. 17 is an enlarged cross sectional view of the second embodiment of the beverage container from FIG. 14;

FIG. 18 is an enlarged portion of the sectional view from FIG. 17 showing several of the plurality of spacer ribs spaced apart from an inner surface of the outer cup so that the insulative air-gap is continuous around a circumference of the inner gap support and showing that plurality of spacer ribs that are stacked on top of one another to provide separate pockets within the insulative air-gap that are maintained by the plurality of spacer ribs when a user grips the beverage container and the outer cup deflects toward the inner gap support;

FIG. 19 is another enlarged portion of the sectional view from FIG. 17 showing one of the plurality of retainer tabs positioned below an annular, outwardly-projecting ridge formed on the outer cup to secure the inner gap support within the interior space of the outer cup in a fully-installed position;

FIG. 20 is a sectional view of a top beverage container stacked within an identical bottom beverage container for storage and/or transport;

FIG. 21 is an enlarged portion of FIG. 20 showing that the inner gap support includes a stacking shoulder that has a shoulder diameter that is less than a floor diameter of the outer cup to limit how far the top beverage container may be inserted into the bottom beverage container to block interaction between the plurality of spacer ribs of the bottom beverage container with the outwardly-projecting ridge of the outer cup of the top beverage container so that removal of the top beverage container from the bottom beverage container is facilitated;

FIG. 22 is a sectional view of a top gap support stacked within an identical bottom gap support for storage and/or transport;

FIG. 23 is an enlarged portion of FIG. 21 showing that each inner gap support includes a stacking shoulder that has a shoulder diameter that is less than a floor diameter of the gap support to limit how far the top gap support may be inserted into the bottom gap support to block interaction between the plurality of spacer ribs of the bottom gap support with the plurality of retainer tabs of the top gap support;

FIG. 24 is a perspective view of the inner gap support from FIGS. 1-10;

FIG. 25 is a side view of the inner gap support from FIG. 24;

FIG. 26 is a side view of the inner gap support from FIG. 25 rotated 90 degrees from the orientation of the inner gap support in FIG. 25;

FIG. 27 is a top view of the inner gap support from FIG. 24;

FIG. 28 is a bottom view of the inner gap support from FIG. 24;

FIG. 29 is a perspective view of the inner gap support from FIGS. 14-23;

FIG. 30 is a side view of the inner gap support from FIG. 29;

FIG. 31 is a side view of the inner gap support from FIG. 30 rotated 90 degrees from the orientation of the inner gap support in FIG. 30;

FIG. 32 is a top view of the inner gap support from FIG. 29;

FIG. 33 is a bottom view of the inner gap support from FIG. 29;

FIG. 34 is a perspective view of the inner gap support from FIGS. 1-10;

FIG. 35 is a side view of the inner gap support from FIG. 34;

FIG. 36 is a side view of the inner gap support from FIG. 35 rotated 90 degrees from the orientation of the inner gap support in FIG. 35;

FIG. 37 is a top view of the inner gap support from FIG. 34;

FIG. 38 is a bottom view of the inner gap support from FIG. 34;

FIG. 39 is a perspective view of the inner gap support from FIGS. 14-23;

FIG. 40 is a side view of the inner gap support from FIG. 39;

FIG. 41 is a side view of the inner gap support from FIG. 40 rotated 90 degrees from the orientation of the inner gap support in FIG. 40;

FIG. 42 is a top view of the inner gap support from FIG. 39;

FIG. 43 is a bottom view of the inner gap support from FIG. 39;

FIG. 44 is a perspective view of another beverage container, in accordance with the present disclosure, with a lid removed from the container to show that the container includes an outer cup and an inner gap support that is sized to fit within an interior space formed in the outer cup to establish an insulative air-gap radially between the outer cup and the inner gap support relative to a central axis of the beverage container so that the beverage container may be filled with hot or cold liquids while insulating the liquids from the outer cup;

FIG. 45 is a cross sectional view taken along line 45-45 in FIG. 44 showing that the inner gap support includes a gap-support brim adapted to engage a cup brim of the outer cup and showing that the gap-support brim includes an upper ring, a curved ring coupled to a radially outer end of the upper ring and extending downwardly away from the upper ring, and an annular rim sealer coupled to a lower surface of the upper ring to engage with an upper surface of the cup brim to block liquids from flowing between the gap-support brim and the cup brim and into the insulative air-gap;

FIG. 46 is a cross sectional view similar to FIG. 45 with the lid at least partially installed on the container to show that a vertical gap may be formed between a portion of the lid and an upper surface of the gap-support brim and showing that lid engages portions of both the gap-support brim and the cup brim to establish sealing interfaces that block the flow of liquid;

FIG. 47 is a perspective view of another beverage container, in accordance with the present disclosure, showing that the container includes an outer cup and an inner gap support that is sized to fit within an interior space formed in the outer cup to establish an insulative air-gap radially between the outer cup and the inner gap support relative to a central axis of the beverage container and showing that the inner gap support includes a spacer section including a plurality of facets that both rigidify the beverage container and provide spacing between the outer cup and the inner gap support to establish the insulative air gap radially therebetween when a user grasps the beverage container;

FIG. 48 is a perspective view of the inner gap support from FIG. 47;

FIG. 49 is a cross sectional view of the container taken along line 49-49 in FIG. 47; and FIG. 50 is a perspective view of the inner gap support from FIGS. 47-49;

FIG. 51 is a side view of the inner gap support from FIG. 50;

FIG. 52 is a side view of the inner gap support from FIG. 51 rotated 90 degrees from the orientation of the inner gap support in FIG. 52;

FIG. 53 is a top view of the inner gap support from FIG. 51; and

Figure 54:
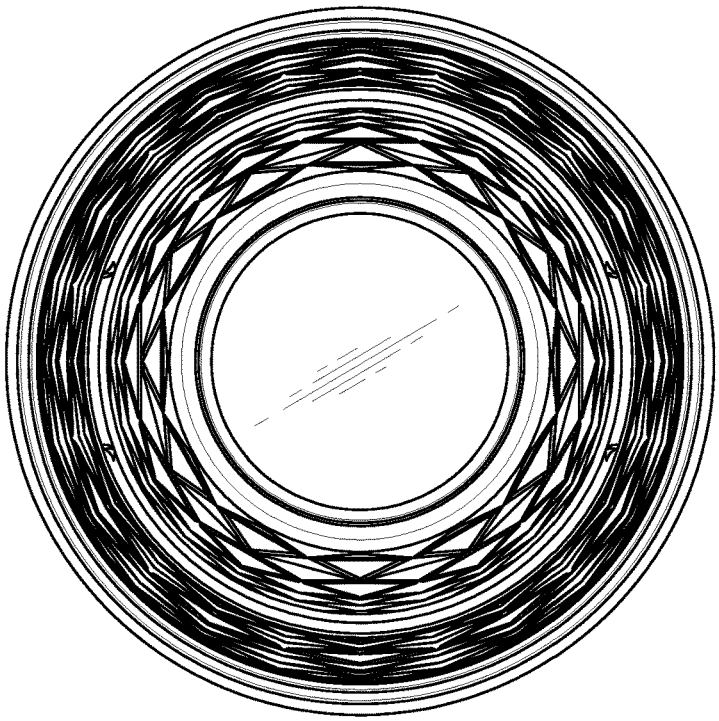

FIG. 54 is a bottom view of the inner gap support from FIG. 51.

DETAILED DESCRIPTION

Figure 1:
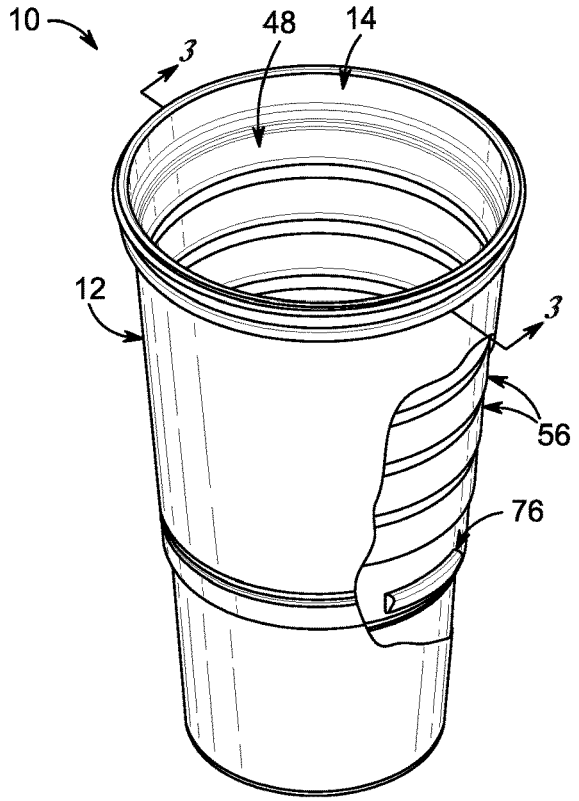
Figure 2:
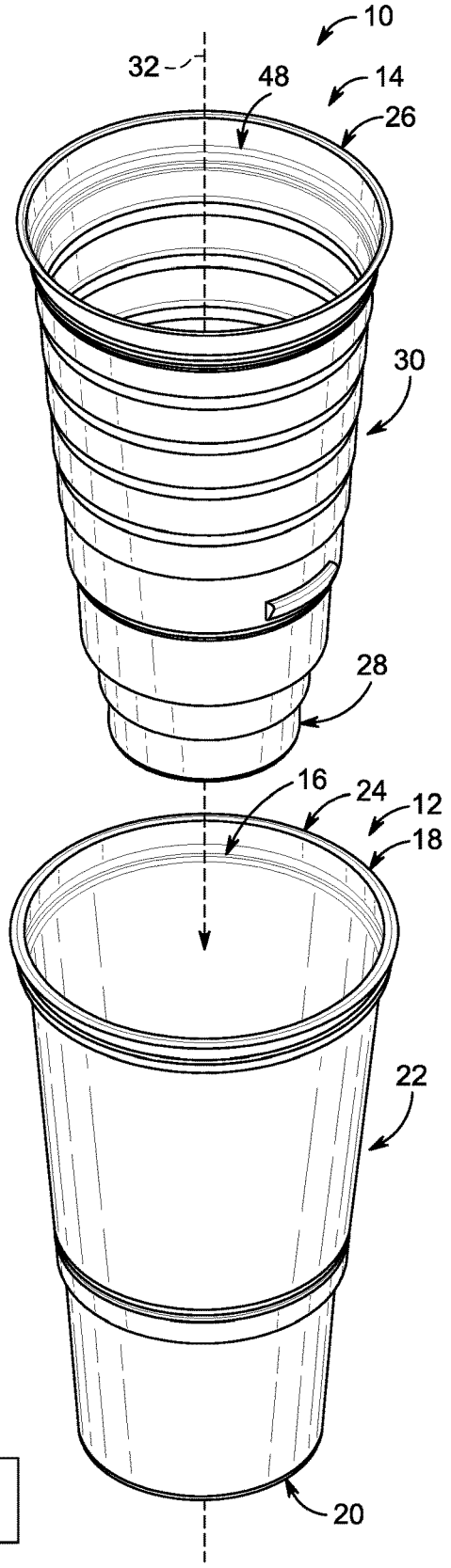
Figure 3:
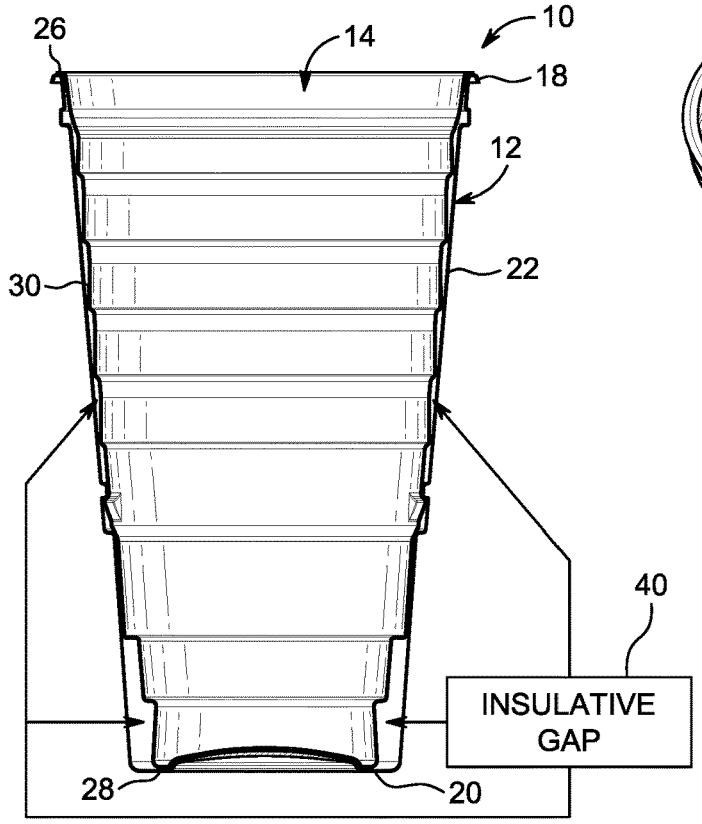

A beverage container 10, in accordance with the present disclosure, is shown in FIGS. 1-10. The beverage container 10 includes an outer cup 12 and an inner gap support 14 that may be inserted into an interior space 16 of the outer cup 12 to establish an insulative air-gap 40 between the outer cup 12 and the inner gap support 14, as shown in FIG. 3, so that the beverage container 10 may be used with both hot and cold products without adversely affecting a user of the beverage container 10. A second embodiment of a beverage container 210 having an outer cup 212 and an inner gap support 214 to establish an insulative air-gap 240 between the outer cup 212 and the inner gap support 214 is shown in FIGS. 14-23. A third embodiment of a beverage container 310 having an outer cup 312 and an inner gap support 314 to establish an insulative air-gap 340 between the outer cup 312 and the inner gap support 314 is shown in FIGS. 44-46. A fourth embodiment of a beverage container 410 having an outer cup 412 and an inner gap support 414 to establish an insulative air-gap 440 between the outer cup 412 and the inner gap support 414 is shown in FIGS. 47-49.

The outer cup 12 includes a cup brim 18, a cup floor 20, and a cup body 22 that extends between and interconnects the cup brim 18 and the cup floor 20 as shown in FIGS. 1-3. The cup brim 18 provides an open mouth 24 that opens into the interior space 16. The cup brim 18 is formed by rolling the outer cup 12 during the thermoforming process to provide a shape for the cup brim 18 that is both ergonomic and comfortable for a user to drink from and that may couple and cooperate with a lid to provide one or more sealing interfaces therebetween. The cup floor 20 provides a bottom for the outer cup 12 so that the outer cup 12 can remain in an upright position while resting on a surface, such as a table. The cup body 22 is coupled to an outer perimeter of the cup floor 20 and extends upwardly to join with the cup brim 18 to provide a one-piece outer cup 12. Some non-limiting examples of suitable outer cups that may be used with the inner gap support 14 described herein are shown and described in U.S. Pat. No. 10,477,998 which is hereby incorporated by reference in its entirety herein for the purpose of describing one or more suitable drink cups that the inner gap support may be sized for use with.

The inner gap support 14 is sized to be inserted into the interior space 16 of the outer cup 12 as shown in FIGS. 1 and 3 and as suggested in FIG. 2. The inner gap support 14 includes a gap-support brim 26, a gap-support floor 28, and a gap-support body 30 that extends between and interconnects the gap-support brim 26 and the gap-support floor 28. The gap-support brim 26 is formed into a flat flange and is coupled to an upper end 31 of the gap-support body 30. The gap-support floor 28 is coupled to a bottom end 34 of the gap-support body 30. The gap-support body 30 is configured to cooperate with a portion of the outer cup 12 to retain the inner gap support 14 to the outer cup 12 and to maintain the insulative air-gap 40 radially between the inner gap support 14 and the outer cup 12.

Figure 4:
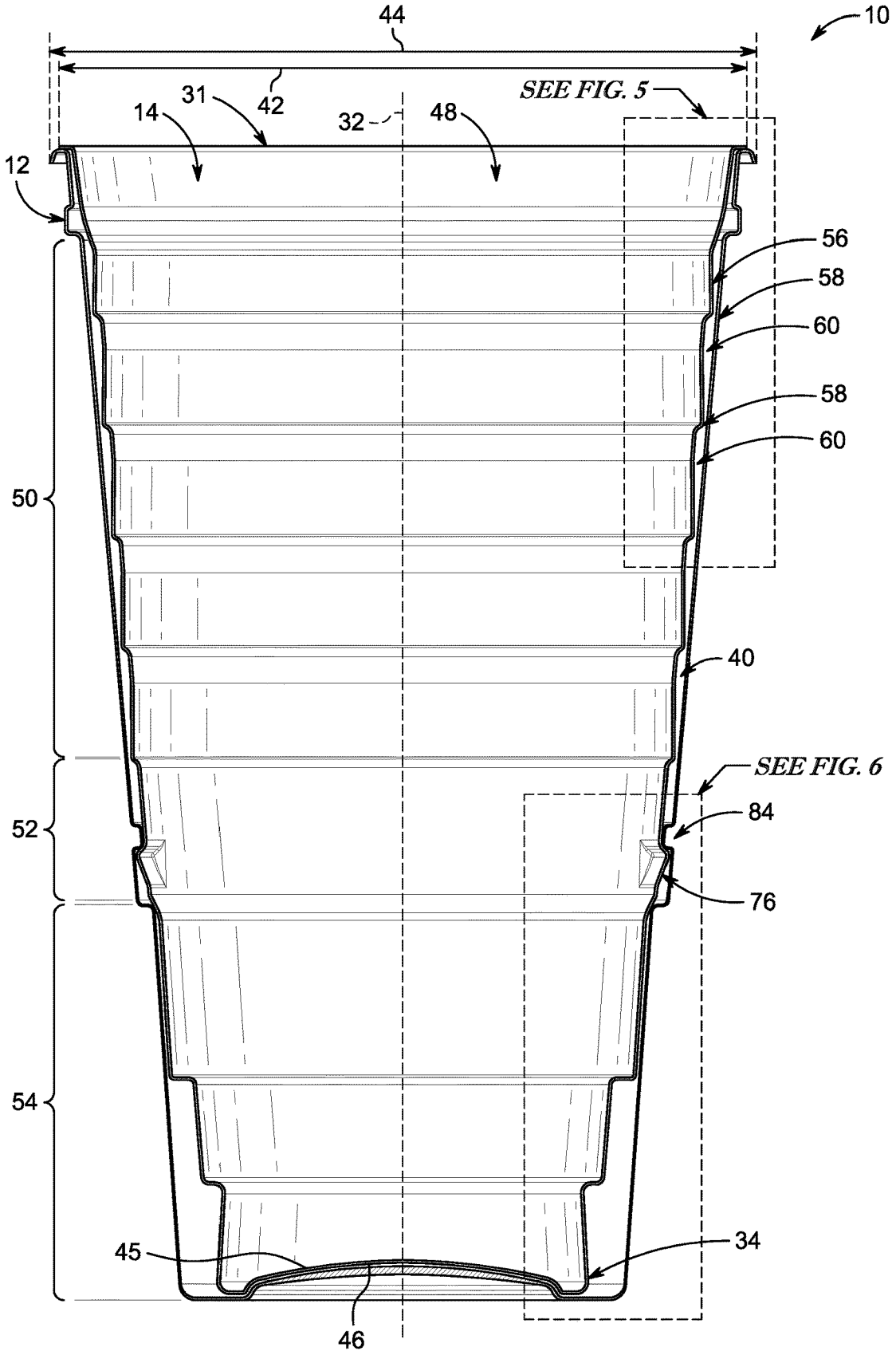

The gap-support brim 26 extends radially outward away from a central axis 32 of the inner gap support 14 and is arranged to rest on an upper surface 38 of the cup brim 18 when the inner gap support 14 is in a fully-installed position in the interior space 16 of the outer cup 12 as shown in FIGS. 3 and 4. The gap-support brim 26 has an outermost diameter 42 that is less than an outermost diameter 44 of the cup brim 18 so that the gap-support brim 26 does not extend outward beyond the cup brim 18. A seal may form between the gap-support brim 26 and the cup brim 18. In some embodiments, the gap-support brim 26 may be omitted such that the gap-support body provides an uppermost extent of the inner gap support 14 and terminates within the interior space 16 of the outer cup 12 and below the cup brim 18.

The gap-support floor 28 extends radially inward from the bottom end 34 of the gap-support body 30 toward the central axis 32 as shown in FIGS. 3 and 4. The gap-support floor 28 is shaped to match and track the cup floor 20 to minimize volume losses of the outer cup 12 when the inner gap support 14 is in the fully-installed position. Accordingly, the gap-support floor 28 may have any suitable shape, but in the illustrative embodiment, the gap-support floor 28 is domed and has a convex upper surface 45 and a concave bottom surface 46.

The gap-support floor 28 and the gap-support body 30 cooperate to define an interior product-receiving chamber 48 that has a volume that closely matches a volume of the interior space 16 of the outer cup 12 to minimize volume losses of the outer cup 12 when the inner gap support 14 is in the fully-installed position. The gap-support body 30 includes a spacer section 50, a retainer section 52, and a stack section 54. The spacer section 50 is configured to provide and maintain the insulative air-gap 40 between at least a portion of inner gap support 14 and at least a portion of the outer cup 12. The retainer section 52 is configured to block unwanted removal of the inner gap support 14 from the interior space 16 of the outer cup 12. The stack section 54 allows the beverage container 10 to be stacked with other similar beverage containers, as shown in FIGS. 7 and 8, and allows the inner gap support 14 to be stacked with other similar gap supports, as shown in FIGS. 9 and 10 while blocking the beverage containers 10 or the gap supports being from being wedged together when stacked.

Figure 5:
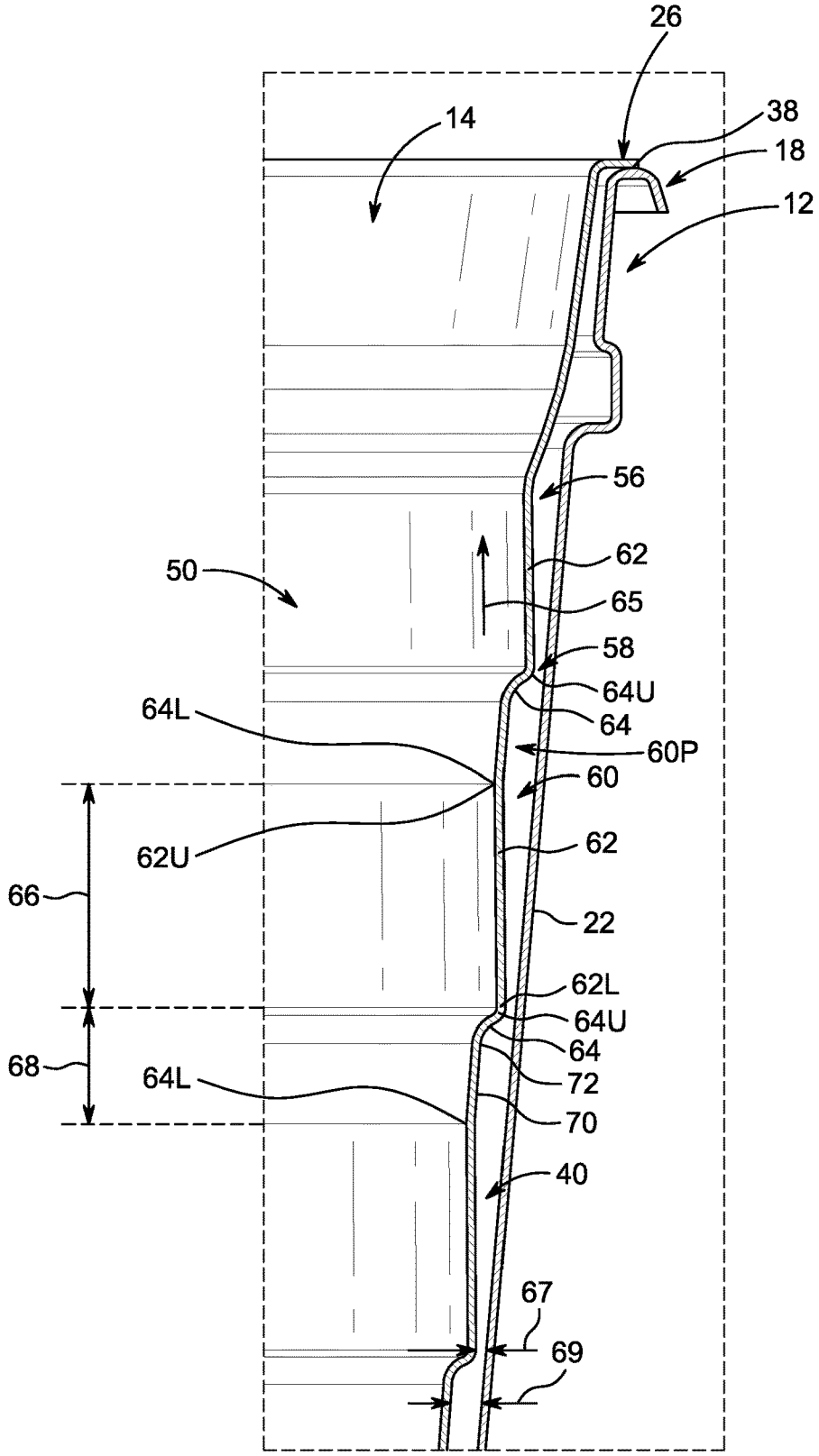

The spacer section 50 includes a plurality of annular spacer ribs 56 (also called projections) arranged in series in a vertical direction relative to the central axis 32 to provide a plurality of peaks 58 and a plurality of air-gap depressions 60 as shown in FIGS. 4 and 5. The plurality of peaks 58 and the plurality of air-gap depressions 60 are juxtaposed relative to one another such that the spacer section 50 alternates between a single peak 58 and a single air-gap depression 60 as the spacer section 50 extends in the vertical direction relative to central axis 32. Each of the peaks 58 is normally spaced apart from the outer cup 12 but may come into contact with the outer cup 12 if a user deforms the outer cup 12 inwardly toward the inner gap support 14. Each of the air-gap depressions 60 is maintained in spaced apart relation to the outer cup 12 to maintain the insulative air-gap 40 between each air-gap depression 60 and the outer cup 12 even when the outer cup 12 is deformed.

Each of the spacer ribs 56 extends circumferentially around the central axis 32 and includes a negatively-sloping upper segment 62 and a positively-sloping lower segment 64 as shown in FIG. 5. Each negatively-sloping upper segment 62 extends away from the central axis 32 from an upper end 62U to a lower end 62L of each negatively-sloping upper segment 62. Each positively-sloping lower segment 64 extends toward the central axis 32 from an upper end 64U to a lower end 64L of each positively-sloping lower segment 64. The lower end 62L of each negatively-sloping upper segment 62 is coupled to a corresponding upper end 64U of a neighboring positively-sloping lower segment 64 to provide one peak 58. Each air-gap depression 60 is defined between two neighboring peaks 58 to provide an individual air-gap pocket 60P therebetween.

Each negatively-sloping upper segment 62 has a height 66 that is greater than a height 68 of each positively-sloping lower segment 64 as shown in FIG. 5. Each negatively-sloping upper segment 62 has a steeper absolute slope than at least a portion of each positively-sloping lower segment 64 so that liquid flowing in a pouring direction 65 toward the open mouth 24 maintains a laminar flow profile. This enhances a user's drinking experience by reducing turbulence in the liquid when the beverage container 10 is tilted to remove liquids from the interior product-receiving chamber 48.

The cup body 22 is spaced apart from each peak 58 by a minimum distance 67, and the cup body 22 is spaced apart from each positively-sloping lower segment 64 by a maximum distance 69 as shown in FIG. 5. The distances 67, 69 are selected to provide desired insulative and structural properties for the beverage container 10 while minimizing volume loses of the outer cup 12 when the inner gap support 14 is being used with outer cup 12 to provide beverage container 10.

The minimum distance 67 may be within a range of about 0.01 inches to about 0.03 inches. In other embodiments, the minimum distance 67 is within a range of about 0.015 inches to about 0.025 inches. In the illustrative embodiment, the minimum distance 67 is about 0.020 inches so that space is kept between the outer cup 12 and the inner gap support 14 when the beverage container 10 is not being held, but so that the outer cup 12 and the inner gap support 14 will engage at peaks 58 when being held for reinforcement. In this way, a thickness of at least one of the outer cup 12 and the inner gap support 14 may be minimized to reduce an amount of material used in beverage container 10 and a weight of the beverage container 10 while still providing the insulative and structural benefits of the beverage container 10.

The maximum distance 69 may be within a range of about 0.05 inches to about 0.1 inches. In other embodiments, the maximum distance 69 is within a range of about 0.06 inches to about 0.09 inches. In one embodiment, the maximum distance 69 is about 0.06 inches. In another embodiment, the maximum distance 69 is about 0.09 inches. The minimum and maximum distances 67, 69 may vary to increase or decrease the insulation provided by the insulative air gap 40. For example, a larger air gap 40 may be used to increase an insulative value of the beverage container 10 while a smaller air gap 40 may be used to increase reinforcement of the beverage container 10. In some embodiments, the distances 67, 69 may vary by about 10 percent from the values described above.

Each positively-sloping lower segment 64 may include a lower band 70 coupled to the upper end 62U of one negatively-sloping upper segment 62 and an upper band 72 coupled to the lower end 62L of another negatively-sloping upper segment 62. The lower band 70 has a steeper absolute slope compared to the upper band 72 so that the transition from each negatively-sloping upper segment 62, to a corresponding lower band 70, and then to a corresponding upper band 72 in the pouring direction 65 is gradual to reduce turbulence in the liquid flowing in the pouring direction 65. Each upper band 72 at least partially provides a corresponding peak 58. In some embodiments, the lower band 70 may be omitted.

Figure 6:
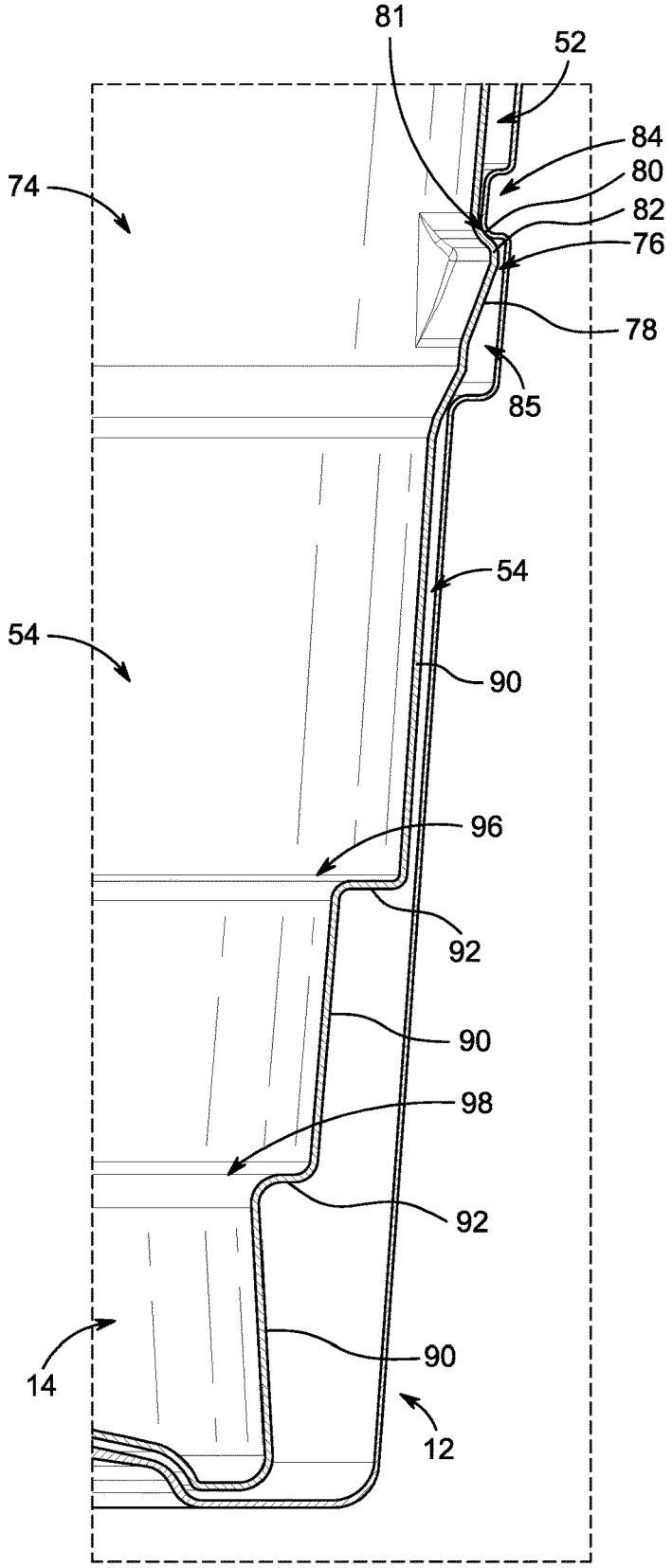
FIG. 6 is another enlarged portion of the sectional view from FIG. 4 showing one of the plurality of retainer tabs positioned below an annular, outwardly-projecting ridge formed on the outer cup to secure the inner gap support within the interior space of the outer cup in a fully-installed position.

The retainer section 52 is positioned below the spacer section 50 and includes an annular retainer band 74 a plurality of retainer tabs 76 that are configured to cooperate with a corresponding feature of the outer cup 12 to retain the inner gap support 14 to the outer cup 12 in the fully-installed position as shown in FIGS. 4 and 6 without the use of any adhesive, glue, or heat sealing between the inner gap support 14 and the outer cup 12. The annular retainer band 74 extends circumferentially about central axis 32 and has a diameter that is slightly less than a corresponding diameter of the outer cup 12 to provide a portion of the insulative air-gap 40 there between. The plurality of retainer tabs 76 are coupled to the annular retainer band 74 and project radially outward away from the annular retainer band 74 and the central axis 32. Illustratively, the retainer section 52 includes a pair of retainer tabs 76 with each retainer tab 76 being positioned on opposite sides of the inner gap support 14 from one another. In other embodiments, any suitable number of retainer tabs 76 may be used.

Each retainer tab 76 extends only partway around the central axis 32 and includes a pusher ramp 78, a retainer 80, and a peak 82 formed at a junction between the pusher ramp 78 and the retainer 80 as shown in FIG. 6. The pusher ramp 78 extends upwardly away from the stack section 54 and outward away from the central axis 32 at an angle relative the axis 32. The pusher ramp 78 is configured to engage an annular reinforcing rib 84 formed on the outer cup 12 as the inner gap support 14 moves toward the fully-installed position. The pusher ramp 78 causes the outer cup 12 to deflect slightly as the pusher ramp 78 engages the reinforcing rib 84 and rides along the reinforcing rib 84 toward the fully-installed position. Once the peak 82 clears the reinforcing rib 84 and has clearance to extend into a pocket 85 below the reinforcing rib 84, the outer cup 12 returns to an undeformed state with the inner gap support 14 in the fully-installed position. In the fully-installed position, the retainer 80 is arranged at least partially below the reinforcing rib 84 and interlocks with the reinforcing rib 84 to block removal of the inner gap support 14 from the interior space 16 of the outer cup 12.

The retainer 80 is located relative to the reinforcing rib 84 such that a clearance gap 81 is established between the retainer 80 and the reinforcing rib 84 when the inner gap support 14 is in the fully-installed position. The clearance gap 81 is intentionally provided to account for small tolerances that occur during manufacturing of the inner gap support 14 and the outer cup 12. Accordingly, the clearance gap 81 ensures that each inner gap support 14 will always reach the fully-installed position when inserted into an outer cup 12. In some embodiments, the clearance gap 81 may not be present.

Although the corresponding structure on the outer cup 12 that interlocks with the retainer tabs 76 is illustratively embodied as a reinforcing rib 84, any suitable structure may be used to retain the inner gap support 14 to the outer cup 12. For example, the cup may be formed to include one or more ledges, ridges, notches, or apertures with which the retainer tabs 76 cooperate. Accordingly, the retainer tabs 76 may include any suitable shape to correspond to a feature on the outer cup 12 to retain the inner gap support 14 to the outer cup 12, or vice versa.

The stack section 54 is located below the retainer section 52 and includes a plurality of generally vertically-extending bands 90 and a plurality of generally horizontally-extending bands 94 as shown in FIGS. 4 and 6. The plurality of generally vertically-extending bands 90 and the plurality of generally horizontally-extending bands 94 each extend annularly around the central axis 32. Generally vertically-extending means extending in a vertical direction relative to the central axis 32 or at an angle to the central axis 32 within a range of 0 degrees to 44 degrees from the axis 32. Generally horizontally-extending means extending in a horizontal direction relative to the central axis or at an angle to the central axis 32 within a range of 46 degrees to 90 degrees from the axis 32.

The plurality of generally vertically-extending bands 90 cooperate with the plurality of generally horizontally-extending bands 94 to provide a container stacking shoulder 96 and a gap-support stacking shoulder 98 as shown in FIG. 6. The container stacking shoulder 96 is configured to block beverage containers 10, 11 from being wedged together when they are stacked for storage as shown in FIGS. 7 and 8. The gap-support stacking shoulder 98 is configured to block inner gap supports 14, 15 from being wedged together when they are stacked for storage as shown in FIGS. 9 and 10.

The beverage containers 10, 11 may be stacked for storage and transportation to decrease an overall space occupancy of a bulk quantity of beverage containers 10, 11 as shown in FIGS. 7 and 8. Beverage containers 10, 11 are identical in the illustrative embodiment. The container stacking shoulder 96 is spaced a first distance 100 from axis 32 that is less than a second distance 102 from axis 32 to an outer edge of the floor 20. When the beverage containers 10, 11 are stacked as shown in FIG. 7, the container stacking shoulder 96 prevents top beverage container 11 from extending into bottom container 10 by a predetermined height 104. The predetermined height 104 corresponds to a location along spacer section 50 of the inner gap support 14 of the bottom beverage container 10 above where the reinforcement rib 84 of the outer cup 12 of the top beverage container 11 would come into contact with one or more of the spacer ribs 56 of the bottom beverage container 10. This prevents the reinforcement rib 84 from extending below the spacer rib 56 which could cause the beverage containers 10, 11 to be wedged together and make it difficult for a user to separate the containers 10, 11.

Two or more inner gap supports 14, 15 may be stacked for storage and transportation to decrease an overall space occupancy of a bulk quantity of inner gap supports 14, 15 as shown in FIGS. 9 and 10. Inner gap supports 14, 15 are identical in the illustrative embodiment. The gap-support stacking shoulder 98 is spaced a first distance 106 from axis 32 that is less than a second distance 108 from axis 32 to an outer edge of the gap-support floor 28. When the inner gap supports 14, 15 are stacked as shown in FIG. 10, the gap-support stacking shoulder 98 prevents top gap support 15 from extending into bottom gap support 14 by a predetermined height 110. The predetermined height 110 corresponds to a location along spacer section 50 of the inner gap support 14 of the bottom gap support 14 that is above where the retainer tabs 76 of the top gap support 15 would come into contact with one or more of the spacer ribs 56 of the bottom gap support 14. This prevents the retainer tabs 76 of each top gap support 15 from extending below the spacer rib 56 of a bottom gap support 14 which could cause the gap supports 14, 15 to be wedged together and make it difficult for a user to separate the gap supports 14, 15.

The outer cup 12 is made from one or more polymer materials and is formed by a thermoforming process. In one example, the outer cup 12 in accordance with the present disclosure made from a formulation which is blended together and extruded into a sheet. The sheet is then formed into outer cups 12, for example, by a thermoforming process. In one example, the formulation comprises polypropylene. In another example, the formulation comprises polystyrene, polyethylene terephthalate, expanded polystyrene, polypropylene, polyethylene, suitable alternatives, and combinations thereof. In another example, the formulation further comprises an additive. Exemplary additives include, clarifiers, process aids, slip agents, mineral fillers, combinations thereof, or any suitable material for improving the drink cup. In some embodiments, the additive is a clarifier. In some embodiments, the additive is a copolymer. In some embodiments, the copolymer is an ethylene-polypropylene copolymer.

Illustratively, both the outer cup 12 and the inner gap support 14 are transparent so that the contents within the beverage container 10 are ascertainable. Accordingly, the inner gap support 14 may include the same or a similar material as the outer cup 12, however, in other embodiments the outer cup 12 and the inner gap support 14 may include different compositions such that their appearance is different. In some embodiments, an appearance, such as color or texture, of one or both of the outer cup 12 and the inner gap support 14 may indicate the contents within the beverage container 10. In accordance with the present disclosure, the term transparent incorporates a range of transparency values including translucent to fully transparent values. Furthermore, the term transparent encompasses transmittance, wide angle scattering (sometimes referred to as haze), narrow angle scattering (sometimes referred to as clarity or see-through quality), and any other factor affecting the ability to see through container 10 or through outer cup 12 or gap support 14 individually. In illustrative embodiments, the transparency is described by clarity and/or haze of container 10 or outer cup 12 or gap support 14 individually.

The haze of container 10, or outer cup 12 or gap support 14 individually, as discussed herein is measured using ASTM D 1003 procedure B which is hereby incorporated by reference herein in its entirety. In the illustrative embodiment, the container 10 includes a haze value within a range of about 15% to about 30%. In some embodiments, the container 10 includes a haze value within a range of about 20% to about 25%. In some embodiments, the container 10 includes a haze value within a range of about 22% to about 25%. In some embodiments, the container 10 includes a haze value of about 24%. In some embodiments, the container 10 includes a haze value of 23.6%. These values are measured when the outer cup 12 and the inner gap support 14 are combined and may vary by about 10% from the values indicated above.

The clarity of container 10, or outer cup 12 or gap support 14 individually, as discussed herein is measured using ASTM D 1746 which is hereby incorporated by reference herein in its entirety. In the illustrative embodiment, the container 10 includes a clarity value within a range of about 65% to about 90%. In some embodiments, the container 10 includes a clarity value within a range of about 70% to about 85%. In some embodiments, the container 10 includes a clarity value within a range of about 70% to about 80%. In some embodiments, the container 10 includes a clarity value of about 75%. In some embodiments, the container 10 includes a clarity value of about 72%. In some embodiments, the container 10 includes a clarity value of 72.4%. These values are measured when the outer cup 12 and the inner gap support 14 are combined and may vary by about 10% from the values indicated above.

In the illustrative embodiment, the outer cup 12 and the inner gap support 14 include a haze value within a range of about 5% to about 20%. In some embodiments, the outer cup 12 and the inner gap support 14 include a haze value within a range of about 12% to about 17%. In some embodiments, the outer cup 12 and the inner gap support 14 include a haze value within a range of about 10% to about 15%. In some embodiments, the outer cup 12 includes a haze value within a range of about 8% to about 12%. In some embodiments, the outer cup 12 includes a haze value within a range of about 9% to about 11%. In some embodiments, the outer cup 12 includes a haze value of about 10%. In some embodiments, the outer cup 12 includes a haze value of 10.2%. In some embodiments, the inner gap support 14 includes a haze value within a range of about 12% to about 16%. In some embodiments, the inner gap support 14 includes a haze value within a range of about 13% to about 15%. In some embodiments, inner gap support 14 includes a haze value of about 15%. In some embodiments, inner gap support 14 includes a haze value of 14.7%. These values are measured when the outer cup 12 and the inner gap support 14 are separated from each other and may vary by about 10% from the values indicated above.

In the illustrative embodiment, the outer cup 12 and the inner gap support 14 include a clarity value within a range of about 70% to about 95%. In some embodiments, the outer cup 12 and the inner gap support 14 include a clarity value within a range of about 75% to about 90%. In some embodiments, the outer cup 12 includes a clarity value within a range of about 75% to about 95%. In some embodiments, the outer cup 12 includes a clarity value within a range of about 85% to about 92%. In some embodiments, the outer cup 12 includes a clarity value of about 90%. In some embodiments, the outer cup 12 includes a clarity value of 89.1%. In some embodiments, the inner gap support 14 includes a clarity value within a range of about 70% to about 85%. In some embodiments, the inner gap support 14 includes a clarity value within a range of about 73% to about 80%. In some embodiments, inner gap support 14 includes a clarity value of about 76%. In some embodiments, inner gap support 14 includes a clarity value of 76.5%. These values are measured when the outer cup 12 and the inner gap support 14 are separated from each other and may vary by about 10% from the values indicated above.

An insulation test was performed to compare the insulative properties of the container 10 in the illustrative embodiment to other containers including: (i) a single walled plastic cup similar to outer cup 12, (ii) a single walled paper cup, (iii) two single walled plastic cups 12 nested together, and (iv) a VERSALITE® container manufactured by Berry Global Company headquartered in Evansville, IN The environment in which the test subjects were located was maintained at a temperature of 70 degrees Fahrenheit and a relative humidity of 50%. The test included steps of: placing 250 g of ice in each cup; pouring a set amount of water (i.e. 300 grams) into each cup; placing a thermocouple (i.e. temperature sensor) in each cup with the ice and water; placing an identical lid on each cup; and measuring the temperature of the contents in each cup every minute for 4 hours. Results of the test are shown in the graph of FIG. 11. The container 10 was able to maintain a temperature of the contents therein below 50 degrees Fahrenheit for a longer period of time than each of the comparative containers as shown in the chart of FIG. 12.

A condensation test was also performed to measure an amount of condensation that formed on the outside surfaces of the container 10 over a set period of time compared to the comparative containers discussed above as shown in FIG. 13A. The environment in which the test subjects were located was maintained at a temperature of 90 degrees Fahrenheit and a relative humidity of 70%. This test included the steps of: filling each container with 250 g of ice and 300 grams of water for a total content weight of 850 grams (filling room conditions included 73 degrees F. and 50% relative humidity); placing each container in the test environment; and measuring the change in weight of the container over a set amount of time (i.e. measuring the amount of condensation that forms on each container). The set amount of time in the exemplary test was 90 minutes. The total condensation gain for each container after 90 minutes is shown in FIG. 13B.

As suggested in FIGS. 13A and 13B, containers with a higher weight gain due to condensation were less effective at insulating their contents. This is because more condensation formed on the containers with less insulative capabilities compared to containers with greater insulative capabilities. In addition to the insulative capabilities shown by the tests described above, container 10 also provides benefits not attributable to the comparative containers such as minimization of volume losses and increased structural reinforcement. Other testing data is shown and described in U.S. Provisional Patent Application No. 63/131,062, filed on Dec. 28, 2020, which is expressly incorporated by reference herein in its entirety for the purpose of describing other tests that may be performed on container 10 and other comparative containers.

A second embodiment of a beverage container 210 having an outer cup 212 and an inner gap support 214 to establish an insulative air-gap 240 between the outer cup 212 and the inner gap support 214 is shown in FIGS. 14-23. Beverage container 210 is substantially similar to beverage container 10 of FIGS. 1-10. Accordingly, the disclosure of beverage container 10 made above is hereby incorporated herein in its entirety for beverage container 210. Similar reference numbers in the 200 series are used below to reference similar features of beverage container 210 that are common between beverage container 210 and beverage container 10. Various differences between beverage containers 10 and 210 are described below.

The outer cup 212 includes a cup brim 218, a cup floor 220, and a cup body 222 that extends between and interconnects the cup brim 218 and the cup floor 220 as shown in FIGS. 14-16. The cup brim 218 provides an open mouth 224 that opens into an interior space 216 of outer cup 212. The inner gap support 214 is sized to be inserted into the interior space 216 of the outer cup 212 as shown in FIGS. 11 and 13 and as suggested in FIG. 12. The inner gap support 214 includes a gap-support brim 226, a gap-support floor 228, and a gap-support body 230 that extends between and interconnects the gap-support brim 226 and the gap-support floor 228. The gap-support brim 226 is formed into a flat flange and is coupled to an upper end 232 of the gap-support body 230. The gap-support floor 228 is coupled to a bottom end 234 of the gap-support body 230. The gap-support body 230 is configured to cooperate with a portion of the outer cup 212 to retain the inner gap support 214 to the outer cup 212 and to maintain the insulative air-gap 240 radially between the inner gap support 214 and the outer cup 212.

The gap-support floor 228 and the gap-support body 230 cooperate to define an interior product-receiving chamber 248 that has a volume that closely matches a volume of the interior space 216 of the outer cup 212 to minimize volume losses of the outer cup 212 when the inner gap support 214 is in a fully-installed position. The gap-support body 230 includes a spacer section 250, a retainer section 252, and a stack section 254. The spacer section 250 is configured to provide and maintain the insulative air-gap 240 between at least a portion of inner gap support 214 and at least a portion of the outer cup 212. The retainer section 252 is configured to block unwanted removal of the inner gap support 214 from the interior space 216 of the outer cup 212. The stack section 254 allows the beverage container 210 to be stacked with other similar beverage containers, as shown in FIGS. 17 and 18, and allows the inner gap support 214 to be stacked with other similar gap supports, as shown in FIGS. 22 and 23 while blocking the beverage containers 210 or the gap supports 214 being from being wedged and stuck together.

The spacer section 250 includes a plurality of annular spacer ribs 256 (also called projections) arranged in series in a vertical direction relative to the central axis 232 to provide a plurality of peaks 258 and a plurality of air-gap depressions 260 as shown in FIGS. 17 and 18. The plurality of peaks 258 and the plurality of air-gap depressions 260 are juxtaposed relative to one another such that the spacer section 250 alternates between a single peak 258 and a single air-gap depression 260 as the spacer section 250 extends in the vertical direction relative to central axis 232. Each of the peaks 258 is normally spaced apart from the outer cup 212 but may come into contact with the outer cup 212 if a user deforms the outer cup 212. Each of the air-gap depressions 260 is maintained in spaced apart relation to the outer cup 12 to maintain the insulative air-gap 240 between each air-gap depression 260 and the outer cup 212. A shape and arrangement of spacer ribs 256 is substantially similar to spacer ribs 56 of gap support 14.

The retainer section 252 is positioned below the spacer section 250 and includes an annular retainer band 274 a plurality of retainer tabs 276 that are configured to cooperate with a corresponding feature of the outer cup 212 to retain the inner gap support 214 to the outer cup 212 in the fully-installed position as shown in FIGS. 17 and 19. The annular retainer band 274 extends circumferentially about central axis 232 and has a diameter that is slightly less than a corresponding diameter of the outer cup 212 to provide a portion of the insulative air-gap 240 there between. The plurality of retainer tabs 276 are coupled to the annular retainer band 274 and project radially outward away from the annular retainer band 274 and the central axis 232. Illustratively, the retainer section 252 includes a pair of retainer tabs 276 with each retainer tab 276 being positioned on opposite sides of the inner gap support 214 from one another. In other embodiments, any suitable number of retainer tabs 276 may be used. A shape and arrangement of retainer tabs 276 is substantially similar to retainer tabs 76 of gap support 14.

The stack section 254 includes a plurality of inwardly-extending stacking tabs 290 as shown in FIGS. 20 and 21. The inwardly-extending stacking tabs 290 are coupled to the retainer band 274 and project radially inward toward the central axis 232. Each inwardly-extending stacking tab 290 extends only partway around the central axis 232 to minimize volume losses. Illustratively, there are four inwardly-extending stacking tabs 290 included in stack section 254, but any suitable number of inwardly-extending stacking tabs 290 may be used. The four inwardly-extending stacking tabs 290 are spaced equidistance apart from one another around axis 232.

The beverage containers 210, 211 may be stacked for storage and transportation to decrease an overall space occupancy of a bulk quantity of beverage containers 210, 211 as shown in FIGS. 20 and 21. Beverage containers 210, 211 are identical in the illustrative embodiment. The inwardly-extending stacking tabs 290 are configured to block beverage containers 210, 211 from being wedged together when they are stacked. When the beverage containers 210, 211 are stacked as shown in FIG. 20, floor 220 of outer cup 212 rests on the inwardly-extending stacking tabs 290 to prevent top beverage container 211 from extending into bottom container 210 by a predetermined height 304. The predetermined height 304 corresponds to a location along spacer section 250 of the inner gap support 214 of the bottom beverage container 210 above where the reinforcement rib 284 of the outer cup 212 of the top beverage container 211 would come into contact with one or more of the spacer ribs 256 of the bottom beverage container 210. This prevents the reinforcement rib 284 from extending below the spacer rib 256 which could cause the beverage containers 210, 211 to be wedged together and make it difficult for a user to separate the containers 210, 211.

Two or more inner gap supports 214, 215 may be stacked for storage and transportation to decrease an overall space occupancy of a bulk quantity of inner gap supports 214, 215 as shown in FIGS. 22 and 23. Inner gap supports 214, 215 are identical in the illustrative embodiment. The retainer tabs 276 are configured to block inner gap supports 214, 215 from being wedged together when they are stacked. When the inner gap supports 214, 215 are stacked as shown in FIG. 23, the retainer tabs 276 prevent top gap support 215 from extending into bottom gap support 14 by a predetermined height 310. The predetermined height 310 corresponds to a location along spacer section 250 of the inner gap support 214 of the bottom gap support 214 that is above where each spacer rib 256 of the top gap support 215 would come into contact with any of the spacer ribs 256 of the bottom gap support 214. This prevents any overhang of the spacer ribs 256 of each top gap support 215 relative to any spacer rib 256 of a bottom gap support 214 which could cause the gap supports 214, 215 to be wedged together and make it difficult for a user to separate the gap supports 214, 215.

A third embodiment of a beverage container 310 having an outer cup 312 and an inner gap support 314 to establish an insulative air-gap 340 between the outer cup 312 and the inner gap support 314 is shown in FIGS. 44-46. Beverage container 310 is substantially similar to beverage container 10 of FIGS. 1-10. Accordingly, the disclosure of beverage container 10 made above is hereby incorporated herein in its entirety for beverage container 310. Similar reference numbers in the 300 series are used below to reference similar features of beverage container 310 that are common between beverage container 310 and beverage container 10. Various differences between beverage containers 10 and 310 are described below.

The outer cup 312 includes a cup brim 318, a cup floor 320, and a cup body 322 that extends between and interconnects the cup brim 318 and the cup floor 320 as shown in FIG. 44. The cup brim 318 provides an open mouth 324 that opens into the interior space 316. The cup brim 318 is formed by rolling the outer cup 312 during the thermoforming process to provide a shape for the cup brim 318 that is both ergonomic and comfortable for a user to drink from and that may couple and cooperate with a lid 311 to provide one or more sealing interfaces therebetween. The cup floor 320 provides a bottom for the outer cup 312 so that the outer cup 312 can remain in an upright position while resting on a surface, such as a table. The cup body 322 is coupled to an outer perimeter of the cup floor 320 and extends upwardly to join with the cup brim 318 to provide a one-piece outer cup 312.

The inner gap support 314 is sized to be inserted into the interior space 316 of the outer cup 312 as shown in FIGS. 44-46. The inner gap support 314 includes a gap-support brim 326, a gap-support floor 328, and a gap-support body 330 that extends between and interconnects the gap-support brim 326 and the gap-support floor 328. The gap-support brim 326 is formed into a flange and is coupled to an upper end of the gap-support body 330. The gap-support floor 328 is coupled to a bottom end of the gap-support body 330. The gap-support body 330 is configured to cooperate with a portion of the outer cup 312 to retain the inner gap support 314 to the outer cup 312 and to maintain the insulative air-gap 340 radially between the inner gap support 314 and the outer cup 312.

The gap-support brim 326 includes an upper ring 327, a curved ring 329 coupled to a radially outer end of the upper ring 327 and extending downwardly away from the upper ring 327, and an annular rim sealer 331 coupled to a lower surface 333 of the upper ring 327 as shown in FIG. 45. The upper ring 327 is coupled to and extends radially outward away from the gap-support body 330. The curved ring 329 has a contour that generally matches a portion of the cup brim 318 and at least partially covers the cup brim 318. A radially outer edge of the curved ring 329 terminates radially inward of a radially outer end of the cup brim 318, but, in some embodiments, the curved ring 329 may extend all the way over and outward of the radially outer end of the cup brim 318. The annular rim sealer 331 is configured to engage with an upper surface 335 of the cup brim 318 to block liquids from flowing between the gap-support brim 326 and the cup brim 318 and into the insulative air-gap 340.

As shown in FIG. 47, a lid 311 may be coupled to the beverage container 310. In some embodiments, the lid 311 may not fit to the beverage container 310 as desired if the inner gap support 314 is used with the outer cup 312. The lid 311 is configured to engage both the gap-support brim 326 and the cup brim 318 to establish seal interfaces therebetween. Any fluid able to flow between the curved ring 329 and the lid 311 is blocked from flowing into the insulative air gap 340 by the annular rim sealer 331.

A fourth embodiment of a beverage container 410 having an outer cup 412 and an inner gap support 414 to establish an insulative air-gap 440 between the outer cup 412 and the inner gap support 414 is shown in FIGS. 47-49. Beverage container 410 is substantially similar to beverage container 10 of FIGS. 1-10. Accordingly, the disclosure of beverage container 10 made above is hereby incorporated herein in its entirety for beverage container 410. Similar reference numbers in the 400 series are used below to reference similar features of beverage container 410 that are common between beverage container 410 and beverage container 10. Various differences between beverage containers 10 and 410 are described below.

The outer cup 412 includes a cup brim 418, a cup floor 420, and a cup body 422 that extends between and interconnects the cup brim 418 and the cup floor 420 as shown in FIG. 47. The cup brim 418 provides an open mouth 424 that opens into the interior space 416. The cup brim 418 is formed by rolling the outer cup 412 during the thermoforming process to provide a shape for the cup brim 418 that is both ergonomic and comfortable for a user to drink from and that may couple and cooperate with a lid to provide one or more sealing interfaces therebetween. The cup floor 420 provides a bottom for the outer cup 412 so that the outer cup 412 can remain in an upright position while resting on a surface, such as a table. The cup body 422 is coupled to an outer perimeter of the cup floor 420 and extends upwardly to join with the cup brim 418 to provide a one-piece outer cup 412.

The inner gap support 414 is sized to be inserted into the interior space 416 of the outer cup 412 as shown in FIGS. 47-49. The inner gap support 414 includes a gap-support brim 426, a gap-support floor 428, and a gap-support body 430 that extends between and interconnects the gap-support brim 426 and the gap-support floor 428. The gap-support brim 426 is formed into a flange and is coupled to an upper end of the gap-support body 430. The gap-support floor 428 is coupled to a bottom end of the gap-support body 430. The gap-support body 430 is configured to cooperate with a portion of the outer cup 412 to retain the inner gap support 414 to the outer cup 412 and to maintain the insulative air-gap 440 radially between the inner gap support 414 and the outer cup 412.

The gap-support floor 428 and the gap-support body 430 cooperate to define an interior product-receiving chamber 448 that has a volume that closely matches a volume of the interior space 416 of the outer cup 412 to minimize volume losses of the outer cup 412 when the inner gap support 414 is in the fully-installed position. The gap-support body 430 includes a spacer section 450, a retainer section 452, and a stack section 454. The spacer section 450 is configured to provide and maintain the insulative air-gap 440 between at least a portion of inner gap support 414 and at least a portion of the outer cup 412. The retainer section 452 is configured to block unwanted removal of the inner gap support 414 from the interior space 416 of the outer cup 412. The stack section 454 allows the beverage container 410 to be stacked with other similar beverage containers and allows the inner gap support 414 to be stacked with other similar gap supports while blocking the beverage containers 410 or the gap supports 414 being from being wedged together.

The spacer section 450 includes a plurality of spacer facets 456 (also called projections) that provide a plurality of peaks 458 and a plurality of air-gap depressions 460 as shown in FIGS. 47 and 49. Each of the spacer facets 456 has a generally diamond shape and includes a pair of angled triangular panels 456A, 456B. The panels 456A, 456B join one another to provide a horizontally oriented rib 456C therebetween that extends only partway around a central axis 411 of the gap support 414. Each rib 456C is located closer to the axis 411 than all other portions of each facet 456. Edges 462 of each panel 456A, 456B are joined with neighboring facets to provide helical creases 462 that extend partway or all the way around the axis 411. In the illustrative embodiment, stack section 454 also includes a plurality of facets 456 that are substantially similar to the facets 456 in spacer section 450. In the illustrative embodiment, the retainer section 452 does not include facets 456, but in some embodiments may include facets 456.

The invention claimed is:

1. An insulative container comprising an outer cup including a cup brim, a cup floor, and a cup body that extends and interconnects the cup brim and the cup floor to locate the cup body between the cup floor and the cup brim, the cup body including at least one annular reinforcement rib, and an inner gap support configured to fit within an interior space of the outer cup, the inner gap support including a gap-support brim, a gap-support floor, and gap-support body that extends between and interconnects the gap-support brim and the gap-support floor to locate the gap-support body between the gap-support floor and the gap-support brim, wherein the inner gap-support is spaced apart from the outer cup to provide an insulative air-gap therebetween and the gap-support body includes a spacer section between the gap-support brim and the gap support floor and including a plurality of projections that provide outwardly-projecting peaks to maintain the insulative air-gap, a retainer section coupled to a lower end of the spacer section and including a plurality of retainer tabs configured to engage with the at least one reinforcement rib of the cup body to retain the inner gap support to the outer cup, and a stacking section coupled to the retainer section so that: (i) the insulative container may be stacked with similar containers and (ii) the inner gap support may be stacked with similar inner gap supports separately from the outer cup, the stacking section including a plurality of stacking tabs offset circumferentially about a central axis of the inner gap support from one another and from each of the retainer tabs and arranged to extend radially inward toward the central axis, wherein the stacking section is spaced apart from the gap-support floor and is located above the gap-support floor, wherein the annular reinforcement rib has an innermost diameter and the retainer tabs have an outermost diameter greater than the innermost diameter of the annular reinforcement rib, and wherein each retainer tab includes a pusher ramp forming a lower portion of each retainer tab, a retainer forming an upper portion of each retainer tab, and a peak formed at a junction between the pusher ramp and the retainer to provide the outermost diameter, and wherein the pusher ramp of each retainer tab is configured to engage the annular reinforcement rib during insertion of the inner gap support into the interior space of the outer cup to cause the outer cup to change from an un-deformed state to a deformed state as the pusher ramp rides along the annular reinforcement rib during insertion of the inner gap support into the interior space of the outer cup, and the outer cup is configured to return to the un-deformed state once the peak clears the annular reinforcement rib and the retainer resides below the annular reinforcement rib.

2. The insulative container of claim 1, wherein each of the projections is an annular spacer rib that extends circumferentially around the central axis of the inner gap support.

3. The insulative container of claim 2, wherein each spacer rib extends includes a negatively-sloping upper segment and a positively-sloping lower segment relative to the central axis such that each negatively-sloping upper segment extends away from the central axis from an upper end to a lower end of each negatively-sloping upper segment and each positively-sloping lower segment extends toward the central axis from an upper end to a lower end of each positively-sloping lower segment.

4. The insulative container of claim 3, wherein an air-gap depression is defined between two neighboring peaks to provide an annular air-gap pocket therebetween.

5. The insulative container of claim 3, wherein each negatively-sloping upper segment has a first height relative to the central axis that is greater than a second height of each positively-sloping lower segment.

6. The insulative container of claim 1, wherein each retainer tab extends only partway around the central axis of the inner gap support, and wherein the retainer is configured to engage the reinforcement rib to block removal of the inner gap support from the outer cup.

7. The insulative container of claim 1, wherein the plurality of retainer tabs provide a gap-support stacking shoulder and tabs provide a container stacking shoulder.

8. The insulative container of claim 1, wherein the cup brim has a first outermost diameter and the gap-support brim has a second outermost diameter less than the first outermost diameter.

9. An insulative beverage container comprising an outer cup including a cup brim, a cup floor, and a cup body that extends and interconnects the cup brim and the cup floor to locate the cup body between the cup floor and the cup brim, the cup body including at least one annular reinforcement rib, and an inner gap support configured to fit within an interior space of the outer cup, the inner gap support including a gap-support brim, a gap-support floor, and gap-support body that extends between and interconnects the gap-support brim and the gap-support floor to locate the gap-support body between the gap-support floor and the gap-support brim, wherein the inner gap-support is spaced apart from the outer cup to provide an insulative air-gap therebetween and the gap-support body includes at least one retainer tab configured to engage with the at least one reinforcement rib of the cup body to retain the inner gap support to the outer cup, a plurality of horizontal projections stacked vertically between the inner-liner brim and the at least one retainer tab, and at least one stacking tab offset circumferentially about a central axis of the inner gap support from the at least one retainer tab and arranged to extend radially inward toward the central axis, wherein the outer cup is configured to change from a un-deformed state, in which each of the horizontal projections is spaced apart from the outer cup, and a deformed state in response to an inward force on the outer cup, in which the outer cup engages at least one of the horizontal projections, and wherein the at least one annular reinforcement rib has an innermost diameter and the at least one retainer tab has an outermost diameter greater than the innermost diameter of the at least one annular reinforcement rib, and wherein the outer cup is configured to deform relative to the inner gap support in response to the at least one retainer tab engaging the at least one annular reinforcement rib as the inner gap support is inserted into the interior space of the outer cup.

10. The insulative beverage container of claim 9, wherein each of the projections is an annular spacer rib that extends circumferentially around the central axis of the inner gap support, and wherein each spacer rib extends includes a negatively-sloping upper segment and a positively-sloping lower segment relative to the central axis such that each negatively-sloping upper segment extends away from the central axis from an upper end to a lower end of each negatively-sloping upper segment and each positively-sloping lower segment extends toward the central axis from an upper end to a lower end of each positively-sloping lower segment.

11. The insulative beverage container of claim 10, wherein each negatively-sloping upper segment has a first height relative to the central axis that is greater than a second height of each positively-sloping lower segment, and wherein each negatively-sloping upper segment has a steeper absolute slope than at least a portion of each positively-sloping lower segment.

* * * * *